US008163458B2

(12) United States Patent
Kikawa et al.

(10) Patent No.: US 8,163,458 B2
(45) Date of Patent: Apr. 24, 2012

(54) METHOD OF MANUFACTURING TONER, TONER, TWO-COMPONENT DEVELOPER, DEVELOPING DEVICE, AND IMAGE FORMING APPARATUS

(75) Inventors: Keiichi Kikawa, Osaka (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 964 days.

(21) Appl. No.: 12/167,519

(22) Filed: Jul. 3, 2008

(65) Prior Publication Data

US 2009/0011351 A1 Jan. 8, 2009

(30) Foreign Application Priority Data

Jul. 6, 2007 (JP) ..... P2007-178960

(51) Int. Cl.
*G03G 9/08* (2006.01)

(52) U.S. Cl. ..... 430/137.14; 430/137.19

(58) Field of Classification Search ..... 430/137.19, 430/137.14

See application file for complete search history.

(56) References Cited

U.S. PATENT DOCUMENTS

| | | | | |
|---|---|---|---|---|
| 5,424,162 | A | 6/1995 | Kohri et al. | |
| 2005/0041523 | A1 | 2/2005 | Nakano | |
| 2007/0166638 | A1 | 7/2007 | Matsumoto et al. | |
| 2008/0014521 | A1 * | 1/2008 | Tsubaki et al. | 430/108.1 |
| 2008/0032224 | A1 * | 2/2008 | Kikawa et al. | 430/109.3 |

FOREIGN PATENT DOCUMENTS

| | | |
|---|---|---|
| JP | 6-161153 | 6/1994 |
| JP | 9-277348 | 10/1997 |
| JP | 2007-187917 | 7/2007 |
| JP | 2008-65247 A | 3/2008 |
| WO | 03/059497 | 7/2003 |

* cited by examiner

*Primary Examiner* — Janis L Dote

(74) *Attorney, Agent, or Firm* — Nixon & Vanderhye P.C.

(57) ABSTRACT

A toner capable of forming high quality images of excellent image reproducibility at high definition and high resolution, being decreased for the bleed-out of a wax ingredient to the surface, causing less filming to a photoreceptor and offset phenomenon in a high temperature region, is provided. The toner is manufactured by a method including a preliminary pulverizing step of pulverizing a melt-kneaded product of toner raw materials in a liquid to obtain a coarse powder slurry containing a coarse toner powder, a finely pulverizing step of passing the coarse powder slurry through a pressure resistant nozzle under heating and pressurization thereby further pulverizing the coarse toner powder to obtain a fine powder slurry containing a fine toner powder and in a heated and pressurized state, a cooling step of cooling the fine powder slurry, and a depressurizing step of depressurizing the fine powder slurry.

10 Claims, 7 Drawing Sheets

METHOD OF MANUFACTURING TONER, TONER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-178960, which was filed on Jul. 6, 2007, the contents of which are incorporated herein by reference in its entirety.

BACKGROUND OF THE INVENTION

1. Field of the Invention

The present invention relates to a method of manufacturing a toner, a toner, a two-component developer, a developing device, and an image forming apparatus.

2. Description of the Related Art

Toners for visualizing latent images have been used in various image forming processes and, as an example thereof, an electrophotographic method has been known.

An electrophotographic image forming apparatus includes a photoreceptor, a charging section which charges the surface of the photoreceptor, an exposure section which irradiates the surface of the photoreceptor in a charged state with a signal light to form an electrostatic latent images corresponding to image information, a developing section which supplies a toner in a developer to electrostatic latent images on the surface of the photoreceptor to form toner images, a transfer section having a transfer roller which transfers the toner images on the surface of the photoreceptor to a recording medium, a fixing section having a fixing roller which fixes the toner images onto the recording medium, and a cleaning section which cleans the surface of the photoreceptor after the transfer of the toner images, and the image forming apparatus develops the electrostatic latent images by a one-component developer containing a toner as a developer or by a two-component developer containing a toner and a carrier to form images. Since the electrophotographic image forming apparatus can form images of good image quality at high speed and at a low cost, the apparatus is utilized, for example, in copying machines, printers, and facsimile units and recent popularization thereof is remarkable. Correspondingly, a demand for the image forming apparatus has become severer. Among all, an importance is attached particularly to high definition, high resolution, and stabilization of image quality formed by the image forming apparatus, and increase in the image forming speed. For attaining them, studies on both of the image forming process and the developer has become indispensable.

For obtaining higher definition and higher resolution of images, decrease in size of the toner particle is one of subjects to be solved regarding the developer with a view point that reproduction of electrostatic latent images at high fidelity and high accuracy is important. The toner particle is generally a resin particle in which a colorant, a wax as a release agent, etc. are dispersed in a binder resin as a matrix. In a general production method for small-sized toner particle, it is generally difficult to decrease the size of the wax dispersed in the binder resin. Accordingly, there is a problem that the wax bleeds out with time from the manufactured small-sized toner particle to cause filming to the photoreceptor. Further, a great amount of the wax bleeds out to the surface of the toner particle and, particularly, at a high temperature, the wax is melted to exhibit tackiness. As a result, an offset phenomenon that the toner is not transferred or fixed to a recording medium but the toner is attached to a transfer roller, a fixing roller, etc. tends to occur frequently.

As a method of decreasing the size of the wax, a method of manufacturing a toner including at least a mixing step of mixing 100 parts by weight of a thermoplastic resin and 1 to 7 parts by weight of a wax, a melt-kneading step of melt-kneading a mixture obtained in the mixing step in which the melt-kneading temperature is within a range: (Tm−20)° C. to (Tm+20)° C. (Tm is a melting temperature of thermoplastic resin), and the temperature of the melt-kneaded product after melt-kneading is (Tm+35)° C. or lower, and a pulverizing and classifying step of cooling, pulverizing and classifying a melt-kneaded product obtained in the melt-kneading step has been proposed (for example, refer to Japanese Unexamined Patent Publication JP-A 6-161153 (1994)). Further, a method of manufacturing a toner of melt-kneading a toner raw material mixture and cooling, pulverizing, and classifying the obtained melt-kneaded product in which the toner raw material mixture is melt-kneaded by using a kneading extrusion device where a downwardly inclined slide-like discharge portion is in adjacent with an outlet of a cylinder portion having, at the inside, a kneading conveying member for kneading and conveying the toner raw material mixture has been proposed (for example, in Japanese Unexamined Patent Publication JP-A 9-277348 (1997)).

The manufacturing methods described above intend to prevent the occurrence of filming to a photoreceptor and the offset phenomenon due to the bleed-out of the wax as the size of the wax contained in the toner particle is decreased. However, since the methods are basically a melt-kneading method known so far, while decrease in size of the wax can be attained, this does not contribute to sufficient decrease in size of the toner particle per se. Accordingly, obtained toner particle is not sufficiently satisfactory in view of the image reproducibility, particularly, definition and resolution.

On the other hand, an emulsifying dispersion apparatus including an emulsifying dispersion section, a conduit channel, a heat exchange section, and a multistage depressurizing section has been proposed,(for example, refer to International Publication WO03/059497). The emulsifying dispersion section prepares a liquid emulsion by emulsifying and dispersing an emulsifying material in a liquid as a matrix by a shearing force. The conduit channel supplies a pressurized liquid emulsion obtained by the emulsifying dispersion section to the multistage depressurizing section. The heat exchange section is disposed on the conduit channel to cool the liquid emulsion. The multistage depressurizing section discharges the liquid emulsion after reducing the pressure of the liquid emulsion supplied from the conduit channel to such a level as causing no bubbling even when the liquid emulsion is discharged into an atmospheric pressure. The emulsifying dispersion apparatus at first prepares a liquid emulsion in which the emulsifying material is dispersed uniformly by dispersing the emulsifying material under pressure into the liquid. Then, the apparatus reduces the pressure of the liquid emulsion stepwise and reduces the pressure finally to such an extent of pressure as causing no bubbling. It intends to prevent the particles of the emulsifying material dispersed in the liquid emulsion from growing thereby obtaining a liquid emulsion in which particles of the emulsifying material of a uniform particle size are dispersed. According to the emulsifying dispersion apparatus, since high shearing force can be applied in the emulsifying dispersion section by the provision of the multistage depressurizing section, an emulsion, for example, of water and oil can be manufactured easily. However, in a case of manufacturing toner particles by the apparatus, control for the particle size is difficult to result in a problem that toner particles of a desired small size cannot be obtained. Further, WO03/059497 does not suggest at all not only that the size of the toner particles is to be decreased but also that a toner where a wax of a smaller size than that of the toner particle dispersed uniformly in the toner particles is to be obtained. Further, WO 03/059497 has no description for applying the emulsifying dispersion apparatus to the manufacture of the toner particles.

SUMMARY OF THE INVENTION

An object of the invention is to provide a toner capable of forming a high quality image excellent in image reproducibility, at high definition and high resolution, and free of occurrence of filming to a photoreceptor and offset phenomenon in a high temperature region attributable to the bleed-out of a waxy and to provide a manufacturing method thereof, a two-component developer, a developing device, and an image forming apparatus.

The invention provides a method of manufacturing a toner comprising:

a preliminary pulverizing step of pulverizing a melt-kneaded product of a toner raw material in a liquid to obtain a coarse powder slurry containing a coarse toner powder;

a finely pulverizing step of passing the coarse powder slurry obtained in the preliminary pulverizing step under heating and pressure through a pressure resistant nozzles thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step; and a depressurizing step of depressurizing the fine powder slurry cooled in the cooling step.

According to the invention, a method of manufacturing a toner including a preliminary pulverizing step, a finely pulverizing step, a cooling step, and a depressurizing step is provided. In the preliminary pulverizing step, the melt-kneaded product of the toner raw material is pulverized in a liquid to obtain a coarse powder slurry containing a coarse toner powder. In the finely pulverizing step, the coarse powder slurry obtained in the preliminary pulverizing step is passed under heating and pressure through a pressure resistant nozzle to further pulverize the coarse toner powder to obtain a fine powder slurry containing a fine toner powder of a volume average particle size smaller than that of the coarse toner powder and in a heated and pressurized state. in the cooling step, the fine powder slurry obtained in the finely pulverizing step is cooled. In the depressurizing step, the fine powder slurry cooled in the cooling step is depressurized.

According to the manufacturing method of the invention, it is important that the melt-kneaded product of the toner raw material (hereinafter simply referred to as "melt-kneaded product" unless otherwise specified) is not dry-pulverized but wet-pulverized in a liquid in the preliminary pulverizing step. This decreases attachment of bubbles to the surface of the coarse toner powder as pulverized substances of the melt-kneaded product. in a case where bubbles are attached to the surface of the coarse toner powder, the bubbles act as a shock absorber upon fine particulation by passing through the pressure resistant nozzle and addition of impact in the fine pulverizing step to result in a problem of hindering fine particulation of the coarse toner powder. Accordingly, for obtaining a toner of a desired small size, it is necessary to conduct the finely pulverizing steps over and over repetitively. Repetition of the pulverizing step requires a long time to increase the production cost of the toner and lower the product yield of the toner, as well as increases the particle size distribution range of the obtained toner. On the contrary, in a case of wet-pulverizing the melt-kneaded product in the preliminary pulverizing step, since bubbles are less attached to the surface of the toner coarse powder formed as described above, the number of repetition for the fine pulverizing steps can be decreased. This can manufacture toner particles uniform in the shape and decreased in a particle size of about 3.5 to 6.5 μm and, further, having a narrow particle size distribution range in a short manufacturing time. Further, by providing the cooling step after the finely pulverizing step, a wax finely particulated to a particle size of about 30 to 300 nm is uniformly dispersed in the small-sized toner particles.

Further, in the invention, it is preferable that the melt-kneaded product of the toner raw material is pulverized in the absence of a dispersant in the preliminary pulverizing step.

According to the invention, by pulverizing the melt-kneaded product of the toner raw material in the absence of the dispersant in the preliminary pulverizing step, the number of bubbles attached to the surface of the formed coarse toner powder is further decreased and pulverization of the coarse toner powder can be conducted further smoothly in the finely pulverizing step. In the wet pulverization, a dispersant is used generally for promoting the dispersion of the pulverized substance. However, in a case of adding shear for pulverizing the melt-kneaded product under the presence of the dispersant, cavitation occurs to generate bubbles which are attached to the surface of the formed coarse toner powder. Among the bubbles, while macro bubbles can be removed, for example, by a deaeration treatment, micro bubbles cannot be completely eliminated. When the coarse toner powder is supplied to the finely pulverizing step in a state of attaching micro bubbles on the surface of the coarse toner powder, the micro bubbles act as an shock absorber as described above to lower the pulverizing efficiently of the coarse toner powder. Further, bubbles may possibly intrude to the inside of the toner particle to form a cavity and lower the durability of the toner particle. Since the dispersant is not added in the preliminary pulverization step, the pulverizing efficiency in the finely pulverizing step is improved remarkably, the number of repetition of the finely pulverizing step can be decreased further, and a toner of small particle size having further uniform shape and size can be manufactured in a good yield. Accordingly, the manufacturing method is extremely advantageous for increasing to an industrial scale.

Further, in the invention, it is preferable that the melt-kneaded product of the toner is pulverized such that a coefficient of variation in a volume particle size distribution of the coarse toner powder is from 25 to 45.

According to the invention, since the melt-kneaded product of the toner raw material is uniformly pulverized such that the coefficient of variation in a volume particle size distribution of the coarse toner powder is from 25 to 45 in the preliminary pulverizing step, the time required for the finely pulverizing step can be shortened and the amount of use for the energy source such as electric power and fuel can be decreased further.

Further, in the invention, it is preferable that the coarse powder slurry not containing particles of coarse toner powder with a particle size of more than 500 μm is obtained in the preliminary pulverizing step.

According to the invention, since the coarse powder slurry not containing the particles of coarse toner powder with a particle size of more than 500 μm is obtained in the preliminary pulverizing step, clogging in the pressure resistant nozzle with the coarse toner powder in the finely pulverizing step can be prevented reliably. As a result, the finely pulverizing step can be conducted more smoothly and the width of the particle size distribution of the obtained fine toner powder can be narrowed further.

Further, in the invention, it is preferable that, in the preliminary pulverizing step, a colloid mill including a cylindrical stator member disposed rotationally and a columnar rotor member disposed rotationally in the inside of the cylindrical stator member is used, and the melt-kneaded product of the toner raw material is pulverized by passing a mixture of the melt-kneaded product of the toner raw material and a liquid through a gap between the cylindrical stator member and the columnar rotor member in the colloid mill.

According to the invention, it is preferable that a colloid mill including a cylindrical stator member disposed rotationally and a columnar rotor member disposed rotationally in the inside of the cylindrical stator member is used as a pulverizing device for pulverizing the melt-kneaded product in the preliminary pulverizing step. That is, by passing the mixture of the melt-kneaded product of the toner raw material and the liquid through the gap between the cylindrical stator member and the columnar rotor member in the colloid mill, a coarse toner powder can be obtained efficiently and in a relatively short time and the number of bubbles attached on the surface of the coarse toner powder can be decreased more. Further, the shape of the coarse toner powder is made uniform and the particle size distribution is narrowed.

Further, in the invention, it is preferable that the gap between the cylindrical stator member and the columnar rotor member is 50 μm or less.

According to the invention, by defining the gap between the cylindrical stator member and the columnar rotor member to 50 μm or less, and preferably 40 to 50 μm (40 μm or more and 50 μm or less), a coarse toner powder properly decreased in size can be obtained. This is effective for preventing clogging in the pressure resistant nozzle in the finely pulverizing step.

Further, in the invention, it is preferable that the liquid is water.

According to the invention, by using water as the liquid for wet-pulverizing the melt-kneaded product, a toner uniform in the shape, size, and property can be manufactured stably. Further, when compared with a case of using other liquid, operator's safety is high, the step control in each of the steps can be simplified, and the treatment for liquid wastes after manufacture of the toner particles is relatively easy. Accordingly, use of water can improve the productivity of the toner particles and decrease the cost.

Further, in the invention, it is preferable that a coarse powder slurry stabilizing step of adding a dispersant to the coarse powder slurry obtained in the preliminary pulverizing step is interposed between the preliminary pulverizing step and the finely pulverizing step.

According to the invention, a coarse powder slurry stabilizing step may be interposed between the preliminary pulverizing step and the finely pulverizing step. In the coarse powder slurry stabilizing step, a dispersant is added to the coarse powder slurry obtained in the preliminary pulverizing step. Thus, since the finely pulverizing step can be conducted under the presence of the dispersant, clogging in the pressure resistant nozzle can be prevented further, and the pulverizing efficiency is improved more. Further, the occurrence of excessive aggregation of the produced fine toner powder can be prevented.

Further, in the invention, it is preferable that an aggregating and pulverizing step of generating a swirl in the fine powder slurry obtained in the finely pulverizing step under heating and pressure to aggregate the fine toner powder and pulverizing the obtained aggregates is interposed between the finely pulverizing step and the cooling step.

According to the invention, the aggregating and pulverizing step may be interposed between the finely pulverizing step and the cooling step. In the aggregating and pulverizing step, a swirl is formed in the fine powder slurry obtained in the finely pulverizing step under heating and pressure to aggregate fine toner powder and the obtained aggregates are pulverized. This extremely facilitates control for the particle size and the particle size distribution of the finally obtained toner particles and the toner particles having desired particle size and particle size distribution can be manufactured easily. The toner particles are substantially uniform in the property such as a charging performance, and image defects due to deterioration of a portion of the toner occurs scarcely. Further, in accordance with the design for the image forming apparatus, a toner suitable thereto can be manufactured easily. Further, the toner particles can be manufactured with no addition of an aggregating agent or the like.

Further, in the invention, it is preferable that the method of manufacturing a toner further comprises an aggregating step of aggregating the fine toner powder contained in the fine powder slurry after the depressurizing step, by using a granulation apparatus having a container for containing a fine powder slurry, a stirring member disposed in the container and stirring the fine powder slurry contained in the container, and two or more screen members formed with a plurality of fine powder slurry flow holes disposed so as to surround the stirring member and penetrating in the direction of the thickness.

According to the invention, the fine toner powder can be aggregated also by using the granulation apparatus having a container, a stirring member, and a screen member without using the aggregating agent or without heating. In the granulation apparatus, the container contains the fine powder slurry after the depressurizing step. The stirring member stirs the fine powder slurry contained in the container. The screen member is disposed so as to surround the stirring member and formed with a plurality of fine powder slurry flow holes penetrating in the direction of the thickness. Also by the method of using the granulation apparatus, the particle size and the particle size distribution can be controlled easily to obtain toner particles which are uniform in the charging performance and other properties.

Further, in the invention, it is preferable that a volume average particle size of the fine toner powder is in a range of from 0.6 to 3 μm (0.6 μm or more and 3 μm or less).

According to the invention, by controlling a volume average particle size of the fine toner powder formed in the finely pulverizing step to a range of from 0.6 to 3 μm, it is possible to make the shape uniform, decrease the size and narrow the particle size distribution width in the finally obtained toner, and a toner of uniform property can be manufactured in a good yield. Particularly, the amount of the fine toner powder which is excessively small in the particle size and has to be regenerated for use is decreased remarkably.

Further, the invention provides a toner manufactured by the method of manufacturing a toner described above.

According to the invention, a toner in which the size is decreased properly to a particle size of about 3.5 to 6.5 μm and a particulated wax is uniformly dispersed therein can be obtained. The toner according to the invention can form high quality images excellent in the reproducibility of original images and at high definition and high resolution by decreasing the size. Further, since bleed-out of the wax scarcely occurs by the finally particulation of the wax, filming to the photoreceptor or occurrence of the offset phenomenon in a high temperature region can be prevented. Further, in a case of performing the image formation by using the toner, the transfer efficiency from the photoreceptor to the recording medium, the transfer efficiency from the photoreceptor to the intermediate medium, and the transfer efficiency from the intermediate medium to the recording medium of toner images are improved to attain reduction of the amount of toner consumption.

Further, the invention provides a two-component developer containing the toner described above and a carrier.

Further, according to the invention, high quality images at high definition and high resolution can be formed with no filming to the photoreceptor or occurrence of the offset phenomenon in a high temperature region due to bleed-out of the wax by the two-component developer containing the toner and the carrier.

Further, the invention provides a developing device that performs development by using a developer containing the toner described above.

According to the invention, high quality toner images at high definition and high resolution can be formed on the photoreceptor by performing development by the developing device using the developer containing the toner described above.

Further, the invention provides an image forming apparatus having the developing device described above.

Further, according to the invention, the image forming apparatus can form high quality images excellent in the reproducibility of the original images at high definition and high resolution by the provision of the developing device described above.

BRIEF DESCRIPTION OF THE DRAWINGS

Other and further objects, features, and advantages of the invention will be more explicit from the following detailed description taken with reference to the drawings wherein:

FIGS. 2A and 2B are views schematically showing the constitution for a main part of a colloid mill, wherein FIG. 2A is a perspective view for the colloid mill, and FIG. 2B is a cross sectional view of the colloid mill in the longitudinal direction;

DETAILED DESCRIPTION

Figure 1:
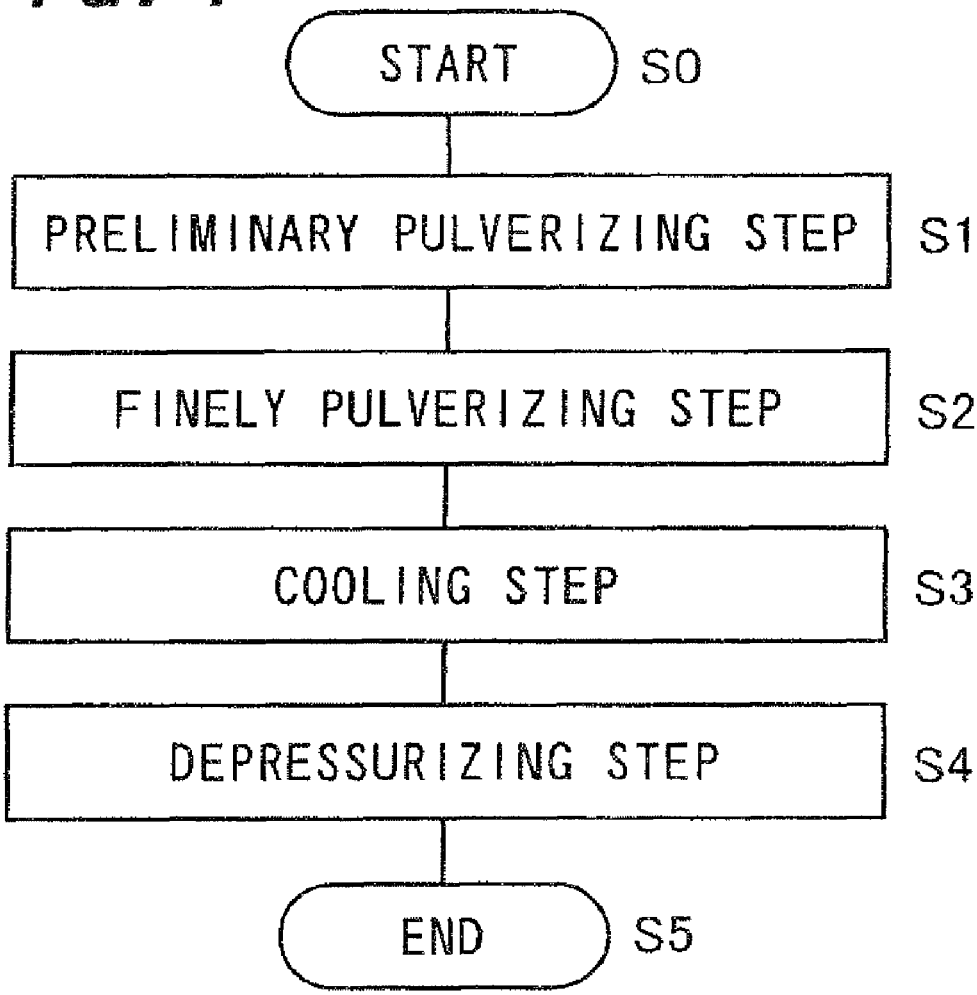
FIG. 1 is a flowchart schematically showing the method of manufacturing a toner according to one embodiment of the invention.

Now referring to the drawings, preferred embodiments of the invention are described below.

FIG. 1 is a flowchart schematically showing the method of manufacturing a toner according to one embodiment of the invention. The manufacturing method of the invention includes a preliminary pulverizing step S1, a finely pulverizing step S2, a cooling step S3, and a depressurizing step S4. In the manufacturing method according to the invention, steps of S1 to S4 may be conducted once, or after conducting the steps from S1 to S4 once and then steps of S2 to S4 may be conducted repetitively.

In the manufacturing method according to the invention, a melt-kneaded product of the toner raw material is prepared at start S0. The toner raw material includes, for example, a binder resin, a colorant, a release agent (wax), and a charge control agent. The binder resin is not particularly restricted so long as it can be granulated in a molten state and those known so far can be used and includes, for example, polyester, acrylic resin, polyurethane, and epoxy resin.

As the polyester, known materials can be used and examples thereof include polycondensations of a polybasic acid and a polyhydric alcohol. As the polybasic acid, those known as monomers for polyesters can be used and examples thereof include aromatic carboxylic acids such as terephthalic acid, isophthalic acid, phthalic acid anhydride, trimellitic acid anhydride, pyromellitic acid, and naphthalene dicarboxylic acid, aliphatic carboxylic acids such as maleic acid anhydride, fumaric acid, succinic acid, alkenyl succinic acid anhydride, and adipic acid, and ethyl esterification products of such polybasic acids. The polybasic acids may be used each alone or two or more kinds of them may be used in combination. Also as the polyhydric alcohol, those known as monomers for polyester can be used and examples thereof include aliphatic polyhydric alcohols such as ethylene glycol, propylene glycol, butanediol, hexanediol, neopentyl glycol, and glycerin, cycloaliphatic polyhydric alcohols such as cyclohexanediol, cyclohexane dimethanol, and hydrogenated bisphenol A, and aromatic diols such as ethylene oxide adducts of bisphenol A, and propylene oxide adducts of bisphenol A. The polyhydric alcohols may be used each alone or two or more kinds of them may be used in combination. The polycondensation reaction of the polybasic acid and the polyhydric alcohol can be conducted in accordance with a customary method and it is conducted, for example, by contacting a polybasic acid and a polyhydric alcohol under the presence or absence of an organic solvent, and under the presence of a polycondensation catalyst, and the reaction is terminated when the acid value, softening points, etc. of the formed polyester reach predetermined values. Thus, the polyester can be obtained. In a case of using a methyl esterification product of the polybasic acid to a portion of a polybasic acid, demethanol polycondensating reaction is taken place. In the polycondensating reaction, the carboxyl group content on the terminal end of the polyester can be controlled and, accordingly, the property of the obtained polyester can be modified by properly changing the blending ratio, the reaction rate, etc. of the polybasic acid and the polyhydric alcohol. Further, in a case of using trimellitic acid anhydride as the polybasic acid, a modified polyester is obtained also by easily introducing the carboxyl group into the main chain of the polyester.

Also for acrylic resin, those known so far can be used and, among all, acidic group-containing acrylic resin can be used preferably. The acidic group-containing acrylic resin can be prepared, for example, by using an acrylic resin monomer containing a acidic group or a hydrophilic group and/or vinylic monomer having an acidic group or a hydrophilic group upon polymerization of the acrylic resin monomer or acrylic resin monomer and the vinylic monomer together. As the acrylic resin monomer, those known so far can be used and examples thereof include acrylic acid which may have a substituent, a methacrylic acid which may have a substituent, acrylate ester which may have a substituent, and a methacrylate ester which may have a substituent. The acrylic resin monomers may be used each alone or two or more kinds of them may be used in combination. Also as the vinylic monomer, those known so far can be used and examples thereof include styrene, α-methylstyrene, vinyl bromide, vinyl chloride, vinyl acetate, acrylonitrile and methacrylonitrile. The vinylic monomer may be used each alone or two or more kinds of them may be used in combination. Polymerization is conducted by using a general radical initiator, via solution polymerization, suspension polymerization, or emulsion polymerization.

Also as the polyurethane, those known so far can be used and, among them, acid group- or basic group-containing polyurethanes can be used preferably. The acidic group- or basic group-containing polyurethanes can be prepared in accordance with known method. For example, acid group- or basic group-containing diol, polyol, and polyisocyanate may be put to addition polymerization. The acid group- or basic group-containing diol can include, for example, dimethylol propionic acid and N-methyl diethanol amine. The polyol includes, for example, polyether polyol such as polyethylene glycol, polyester polyol, acryl polyol, and polybutadiene polyol. The polyisocyanate includes, for example, tolylene diisocyanate, hexamethylene diisocyanate and isophoron diisocyanate. The ingredients may be used each alone or two or more kinds of them may be used in combination.

Also as the epoxy resin, those known so far can be used and, among them, acidic group- or basic group-containing epoxy resin. can be used preferably. The acidic group- or basic group-containing epoxy resin can be prepared, for example, by adding or addition polymerizing a polybasic carboxylic such as adipic acid or trimellitic acid anhydride or an amine such as dibutyl amine or ethylene diamine to an epoxy resin as a base.

Among the binder resins, polyester is preferred. Since the polyester is excellent in the transparency and can provide preferred powder fluidity, low temperature fixing property, and secondary color reproducibility to the obtained toner particles, it is suitable to the binder resin for the color toner. Further, a polyester and an acrylic resin may be used by grafting.

Further, with a view point of easy conduction of the granulating operation, kneadability with the colorant, and uniform shape and size of the obtained toner particles, a binder resin with a softening point of 150° C. or lower is preferred, and a binder resin of a softening point of 60 to 150° C. is particularly preferred. Among them, a binder resin having a weight average molecular weight of from 5,000 to 500,000 is preferred. The binder resins may be used each alone or two or more of different resins may be used in combination. Further, even when those for an the identical resin are selected, a plural kinds of resins which are different partially or entirely in molecular weight, monomer composition, etc. can be used.

In a case of manufacturing an encapsulated toner by the manufacturing method according to the invention, a binder resin as a core material and a binder resin forming an outer shell layer are used.

The binder resin as the core material is preferably those containing one or more kinds selected from styrenic monomers, maleic acid monoesters, and fumaric acid monoester monomers. In a case of containing the styrenic monomer, it is preferably from 30 to 95% by weight and, particularly preferably, from 40 to 95% by weight based on the entire amount of the monomer. In a case of containing the maleic acid monoester and/or fumaric acid monoester, it is preferably from 5 to 70% by weight and, particularly preferably, from 5 to 50% by weight based on the entire amount of the monomer.

Examples of the styrenic monomer contained in the binder resin as the core material include styrene, α-methylstyrene, halogenated styrene, vinyl toluene, 4-sulfonamide styrene, 4-styrene sulfonic acid, and divinylbenzene. Examples of the maleic acid monoester type monomer include diethyl maleate, dipropyl maleate, dibutyl maleate, dipentyl maleate, dihexl maleate, heptyl maleate, octyl maleate, ethylbutyl maleate, ethyloctyl maleate, butyloctyl maleate, butylhexyl maleate, and pentyloctyl maleate. Examples of the fumaric acid monoester monomer includes diethyl fumarate, dipropyl fumarate, dibutyl fumarate, dipentyl fumarate, dihexyl fumarate, heptyl fumarate, octyl fumarate, ethylbutyl fumarate, ethyloctyl fumarate, butyloctyl fumarate, butylhexyl fumarate, and pentyloctyl fumarate.

Further, examples of the binder resin as the core material include, in addition to the monomers described above, (meth) acrylate ester monomer, (meth)acrylamide alkyl sulfonic acid monomer, (meth)acrylic polyfunctional monomer, and peroxide monomer. Examples of the (meth)acrylate ester monomer include methyl(meth)acrylate, ethyl(meth)acrylate, propyl(meth)acrylate, n-butyl(meth)acrylate, isobutyl(meth) acrylate, octyl(meth)acrylate, dodecyl(meth)acrylate, lauryl (meth)acrylate, stearyl(meth)acrylate, cyclohexyl(meth) acrylate, phenyl(meth)acrylate, benzyl(meth)acrylate, furfuryl(meth)acrylate, hydroxyethyl(meth)acrylate, hydroxybutyl(meth)acrylate, dimethylaminomethyl(meth) acrylate, dimethylaminoethyl(meth)acrylate, 2-ethylhexyl (meth)acrylate, and 2-chloroethyl(meth)acrylate.

Examples of the (meth)acrylamide alkyl sulfonic acid monomer include acrylamide methyl sulfonate, acrylamide ethyl sulfonate, acrylamide n-propyl sulfonate, acrylamide isopropyl sulfonate, acrylamide n-butyl sulfonate, acrylamide s-butyl sulfonate, acrylamide t-butyl sulfonate, acrylamide pentyl sulfonate, acrylamide hexyl sulfonate, acrylamide heptyl sulfonate, acrylamide octyl sulfonate, methacrylamide methyl sulfonate, methacrylamide ethyl sulfonate, methacrylamide n-propyl sulfonate, methacrylamide isopropyl sulfonate, methacrylamide n-butyl sulfonate, methacrylamide s-butyl sulfonate, methacrylamide t-butyl sulfonate, methacrylamide pentyl sulfonate, methacrylamide hexyl sulfonate, methacrylamide heptyl sulfonate, and methacrylamide octyl sulfonate.

Examples of the (meth)acrylic polyfunctional monomer include 1,3-butylene glycol diacrylate, 1,5-pentane diol diacrylate, neopentyl glycol diacrylate, 1,6-hexane diol diacrylate, diethylene glycol diacrylate, triethylene glycol diacrylate, tetraethylene glycol diacrylate, polyethylene glycol diacrylate, polyethylene glycol #400 diacrylate, polyethylene glycol #600 diacrylate, polypropylene diacrylate, N,N'-methylene bis acrylamide, pentaerythritol triacrylate, trimethylol propane triacrylate, tetramethylol propane triacrylate, 1,4-butane diol diacrylate, diethylene glycol dimethacrylate, 1,3-buthylene glycol dimethacrylate, 1,5-pentanediol dimethacrylate, neopentyl glycol dimethacrylate, 1,6-hexanediol dimethacrylate, diethyleneglycol dimethacrylate, triethylene glycol dimethacrylate, tetraethylene glycol dimethacrylate, polyethylene glycol dimethacrylate, polyethylene glycol #400 dimethacrylate, polyethylene glycol #600 dimethacrylate, polypropylene dimethacrylate, N,N'-methylene bismethacrylamide, pentaerythritol trimethacrylate, trimethylol propane trimethacrylate, tetramethylol propane trimethacrylate, 1,4-butanediol dimethacrylate, 2,2-bis(4-methacryloxypolyethoxyphenyl)propane, aluminum methacrylate, calcium methacrylate, zinc methacrylate, and magnesium methacrylate.

Examples of the peroxide monomer include t-butylperoxymethacrylate, t-butylperoxy chrotonate, di(t butylperoxy) fumarate, t-butylperoxyallylcarbonate, tri-t-butyl pertrimellitate, tri-t-amino pertrimellitate, tri-t-hexyl pertrimellitate, tri-t-1,1,3,3-tetramethyl butyl pertrimellitate, tri-t-cumyl pertrimellitate, pertrimellitic acid, tri-t-(p-isopropyl)cumyl ester, tri-t-butyl pertrimellitate, tri-t-amino pertrimesicate, tri-t-hexyl pertrimesicate, tri-t-1,1,3,3-tetramethylbutyl pertrimesicate, tri-t-cumyl pertrimesicate, tri-t-(p-isoproyl) cumyl pertrimesicate, 2,2-bis(4,4-di-t-butyl peroxycyclohexyl)propane, 2,2-bis(4,4-di-t-hexyl peroxycyclohexyl) propane, 2,2-bis(4,4-di-t-amyl peroxycyclohexyl)propane, 2,2-bis(4,4-di-t-octyl peroxycyclohexyl)propane, 2,2-bis(4,4-di-α-cumyl peroxycyclohexyl)propane, 2,2-bis(4,4-di-t-butyl peroxycyclohexyl)butane, and 2,2-bis(4,4-di-t-octyl peroxycyclohexyl)butane.

The binder resin as the core material is preferably those obtained by polymerizing one or more of the monomers described above by two stage polymerization. The two-stage polymerization can be conducted, for example, by solution polymerization, suspension polymerization, and emulsion polymerization and, among them, the solution polymerization is preferred. The binder resin obtained by the two-stage polymerization has at least one maximal value each one on the low molecular side and the high molecular side in a molecular weight distribution curve. In the core material, styrene-acrylic resin, polyurethane, styrene-butadiene resin, polyester, epoxy, etc. may be contained together with the binder resin described above.

On the other hand, the outer shell layer is formed by a thermoplastic resin and the thermoplastic resin includes, for example, vinylic polymer, polyester, epoxy resin, and polyurethane. Among them, the vinylic polymer, and polyester, etc. are preferred and, examples thereof include specifically styrene-n-butyl acrylate copolymer, styrene-methylmethacrylate-n-butyl methacrylate copolymer, and terephthalic acid-bisphenol A propylene oxide condensation product.

as the colorant, organic dyes, organic pigments, inorganic dyes, and inorganic pigments used customarily in the field of electrophotography can be used.

Examples of a black colorant include carbon black, copper oxide, manganese dioxide, aniline black, activated carbon, non-magnetic ferrite, magnetic ferrite, and magnetite.

Examples of a yellow pigment include chrome yellow, zinc yellow, cadmium yellow, yellow iron oxide, mineral fast yellow, nickel titanium yellow, nable yellow, naphthol yellow S Hanza Yellow G, Hanza yellow 10G, benzidine yellow G, benzidine yellow GR, quinoline yellow lake, permanent yellow NCG, tartrazine late, C.I. pigment yellow 12, C.I. pigment yellow 13, C.I. pigment yellow 14, C.I. pigment yellow 15, C.I. pigment yellow 17, pigment yellow 93, C.I. pigment yellow 94, and C.I. pigment yellow 138.

Examples of a orange colorant include red chrome yellow, molybdenum orange, permanent orange GTR, pyrazolone orange, Vulcan orange, indanthrene brilliant orange RK, benzidine orange G, indanthrene brilliant orange GK, C.I. pigment orange 31 and C.I. pigment orange 43.

Examples of a red colorant include red iron oxide, cadmium red, red lead, mercury sulfide, cadmium, permanent red 4R, Lithol Red, pyrazolone red, watching red, calcium salt, lake lad C, lake red D, brilliant carmine 6B, eosine lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178 and C.I. pigment red 222.

Examples of a purple colorant include manganese purple, fast violet B, and methyl violet lake.

Examples of a blue colorant include Prussian blue, cobalt blue, alkali blue lake, Victoria blue lake, phthalocyanine blue, non-metal phthalocyanine blue, phthalocyanine blue partial chloride, fast sky blue, indanthrene blue BC, C.I. pigment blue 15, C.I. pigment blue 15:2, C.I. pigment blue 15:3, C.I. pigment blue 16 and C.I. pigment blue 60.

Examples of a green colorant include chrome green, chromium oxide, pigment green B, malachite green lake, final yellow green G and C.I. pigment green 7.

Examples of a white colorant include compounds such as zinc powder, titanium oxide, antimony white, and zinc sulfide.

The colorants may be used each alone or two or more of different colors may also be used in combination. Further, even when those for an identical color are selected, two or more kinds of them may also be used in combination. While there is no particular restriction on the ratio of use between the binder resin and the colorant and it is usually preferably from 0.1 to 20 parts by weight, more preferably, from 0.2 to 10 parts by weight based on 100 parts by weight of the binder resin.

As the release agent, those used customarily in this field can be used and examples thereof include petroleum waxes such as paraffin wax and derivatives thereof and microcrystalline wax and derivatives thereof, synthesis hydrocarbon waxes such as Fischer-Tropsch wax and derivatives thereof, polyolefin wax and derivatives thereof, low molecular weight polypropylene wax and derivatives thereof, polyolefin polymer wax (low molecular weight polyethylene wax, etc.) and derivatives thereof, plant waxes such as carnauba wax, and derivatives thereof, rice wax and derivatives thereof, Candellila wax and derivatives thereof, and wood wax, animal wax such as bees wax and whale wax, synthetic oil and fat wax such as aliphatic acid amino, phenolic fatty acid ester, long chained carboxylic acids and derivative thereof, long chain alcohols and derivatives thereof, and silicone polymer, and higher fatty acids. The derivatives include, for example, oxides or block copolymers of vinyl monomer with wax, graft modification products of vinylic monomer and wax. While the amount of the wax to be used is not particularly restricted and can be selected properly from a wide range and it is preferably from 0.2 to 20 parts by weight based on 100 parts by weight of the binder resin.

As the charge control agent, those for positive charge control and negative charge control used customarily in this field can be used. Examples of the charge control agent for positive charge control include basic dyes, quaternary ammonium salts, quaternary phosphonium salts, aminopyrine, pyrimidine compounds, polynulear polyamino compounds, aminosilane, niglosine dyes and derivatives thereof, triphenyl methane derivatives, guanidine salts, and amidine salts. Examples of the charge control agent for negative charge control include oil soluble dyes such as oil black and spirone black, metal-containing azo compounds, azo complex dyes, metal naphthate salts, salicylic acid derivative, and metal complex and metal salt of salicylic acid and derivatives thereof (metal includes chromium, zinc, zirconium, etc.) fatty acid soap, long chained alkyl carboxylates, and resin acid soap. The charge control agents may be used each alone or two or more kinds of them may optionally be used in combination. While the amount of the charge control agent to be used is not particularly restricted and can be properly selected from a wide range, it is preferably from 0.5 to 3 parts by weight based on 100 parts by weight of the binder resin.

Further, the toner raw material may optionally contain general toner additives.

The melt-kneaded product of the toner raw material can be prepared, for example, by dry mixing various toner raw materials in a mixer, and then melt-kneading them while heating to a temperature of a melting temperature or higher of a binder resin (usually about 80 to 200° C. and, preferably, about 100 to 150° C.). In this case, known mixers can be used and include, for example, HENSCHEL MIXER (trade name, manufactured by Mitsui Mining Co., Ltd.), SUPERMIXER (trade name, manufactured by KAWATA MFG. Co., Ltd.), Henschel type mixing apparatus such as MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.). For melt-kneading, general kneaders such as twin screw extruders, three rolls and Labo blast mill can be used. More specifically, they include, for example, single screw or twin screw extruders such as TEM-100B (trade name, manufactured by Toshiba Machine Co., Ltd.), and PCM-65/87 (trade name, manufactured by Ikegai, Ltd.), and open-roll types such as KNEADEX (trade name, manufactured by Mitsui Mining Co., Ltd.)

[Preliminary Pulverizing Step S1]

In the preliminary pulverizing step S1, the melt-kneaded product of the toner raw material (hereinafter simply referred to as "melt-kneaded product" unless otherwise specified) is pulverized in a liquid to prepare a coarse powder slurry containing a coarse toner powder. The preliminary pulverizing step S1 is specifically conducted by applying a pulverizing treatment by a pulverizer capable of wet pulverization to a mixture of the liquid and the melt-kneaded product. While the liquid is not particularly restricted so long as it is a liquid not dissolving the coarse toner powder but capable of uniformly dispersing the powder, water is preferred in view of easy step control and liquid waste disposal after the completion of the entire steps. The ratio of use between the liquid and the melt-kneaded product is not particularly restricted, and a ratio at which the pulverizing treatment can be proceeded smoothly may be selected properly depending on the pulverizing device to be used. The pulverizing device is not particularly restricted so long as it can conduct wet pulverization and includes, for example, a vibration mill, an automatic mortar, a sand mill, DYNO-MILL, a coball mill, an attritor, a planetary ball mill, a ball mill, and a colloid mill. Among them, the colloid mill is preferred.

Figure 2B:
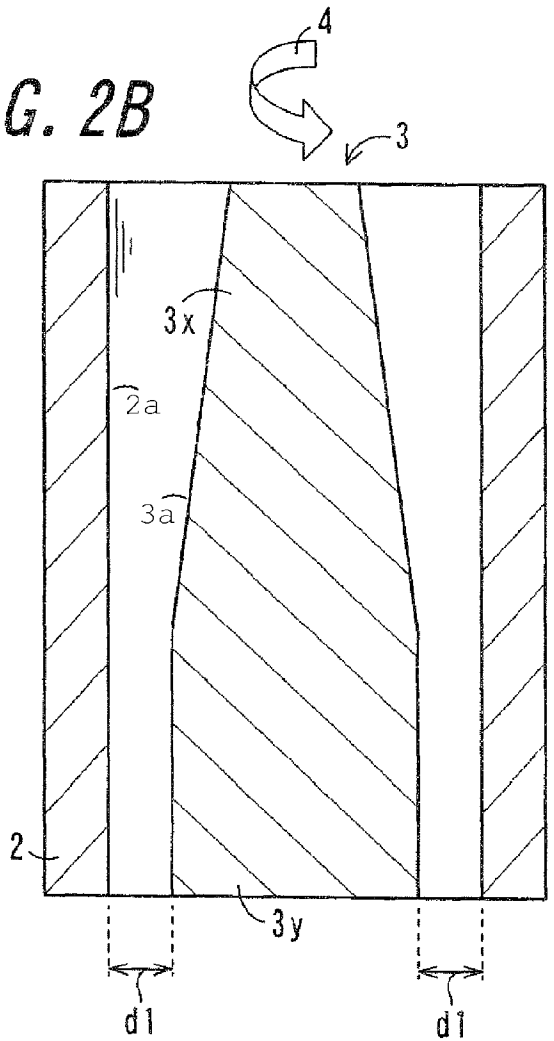
Figure 2A:
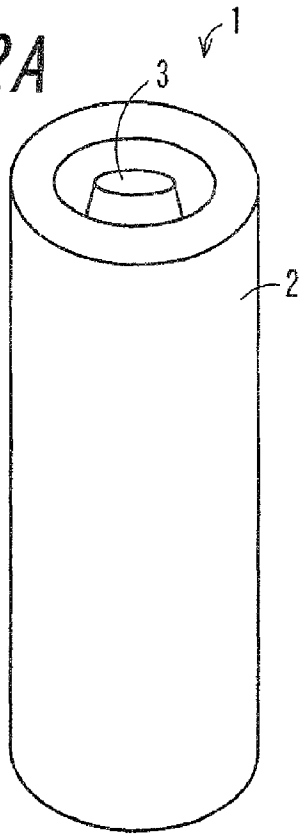

FIGS. 2A and 2B are views schematically showing the constitution for a main part of a colloid mill 1. FIG. 2A is a perspective view for the colloid mill 1. FIG. 2B is a cross sectional view of the colloid mill 1 in the longitudinal direction. The colloid mill 1 includes a stator member 2 and a rotor member 3. The stator member 2 is a cylindrical member disposed so as to extend in the vertical direction. The inner circumferential surface 2*a* of the stator member 2 is formed with asperities serving as a file. The rotor member 3 is a circular columnar member located in the inside of the stator member 2 spaced at the outer circumferential surface 3*a* thereof with a gap to the circumferential surface 2*a* of the stator member 2, and disposed so as to be driven rotationally about an axis thereof, that is, in a direction of an arrow 4 by a driving section (not shown). The circumferential surface 3*a* of the rotor member 3 is formed with asperities serving as a file, in the same manner as the inner circumferential surface 2*a* of the stator member 2. Further, one end 3*x* of the rotor member 3 in the vertical direction is gradually enlarged for the cross sectional diameter in the direction perpendicular to the vertical direction toward the vertical downward direction, and is in contiguous with the other end 3*y*. The other end portion 3*y* has an identical cross sectional diameter for any portion thereof in the direction perpendicular to the vertical direction. Since the rotor member 3 has such a shape, the gap between the stator member 2 and the rotor member 3 is gradually narrowed toward the vertical downward direction and it is made constant from the midway thereof. In this case, the distance between the stator member 2 and the other end 3*y* of the rotor member 3 is defined as a gap d1.

In the colloid mill 1, by passing the mixture of the liquid and the melt-kneaded product through the gap between the stator member 2 and the rotor member 3 under the rotation of the rotor member 3, the melt-kneaded product is pulverized to form a coarse toner powder. In this case, the gap d1 is controlled, preferably, 50 μm or less and, more preferably, from 40 to 50 μm. By adjusting the gap d1 within the range described above, a coarse toner powder having a coefficient of variation in a volume particle distribution preferably of 25 to 45 and, more preferably, 25 to 40 is obtained. In this case, the volume average particle size of the coarse toner powder is about 20 to 100 μm and, preferably, about 20 to 70 μm. Further, for preventing occurrence of clogging in the pressure resistant nozzle and conducting fine pulverization smoothly in the finely pulverizing step S2 as the succeeding step, the content of the coarse powder with a particle size of more than 500 μm in the coarse powder slurry is preferably decreased. When pulverization by repetitively passing the slurry through the gap till the volume average particle size of the coarse toner powder is decreased to less than 100 μm as a measure, a coarse powder slurry where the content of the coarse toner powder with the particle size of more than 500 μm is not so much as causing trouble in the next step can be obtained. As described above, by conducting pulverization such that the particle size distribution of the coarse toner powder is controlled, and the amount of the coarse toner powder with the particle size of more than 500 μm is decreased, occurrence of clogging in the pressure resistant nozzle can be prevented and the fine pulverization can be conducted smoothly in the fine pulverizing step S2 as the next step. Further, while the flow rate of the mixture of the liquid and the melt-kneaded product is not particularly restricted, it is, preferably, from 30 to 70 kg/h and, more preferably, 45 to 55 kg/h. Further, while the pass of the mixture of the liquid and the melt-kneaded product through the gap is conducted usually at ordinary temperature and pressure, it may be optionally conducted under increased pressure or reduced pressure, and under heating or cooling. For the colloid mill, commercial products can be used and they include, for example, PUC COLLOID MILL TYPE 60 (trade name, manufactured by Nippon Ball Valve Co., Ltd.), and DISPAMILL D (trade name, manufactured by Hosokawa Micron Corporation). In the commercial products, the gap between the stator member and the other end of the rotor member can be controlled within a range from 40 to 200 μm.

Further, in the preliminary pulverizing step S1, it is preferable that the dispersant is not added to the mixture of the liquid and the melt-kneaded product. The dispersant means herein an organic compound used for stably dispersing the coarse toner powder without causing coagulation in the liquid. Since the dispersant is not added, attachment of bubbles on the surface of the formed coarse toner powder can be prevented and the coarse toner powder can be pulverized finely in the finely pulverizing step S2 as the next step. While all dispersants are included, used so far in the field of the toner manufacturing technology are included, those used mainly are water soluble polymeric dispersants. The water soluble polymeric dispersant includes, for example, (meth)acrylic polymers, polyoxyethylene type polymers, cellulose type polymers, polyoxyalkylene alkyl aryl ether sulfates and polyoxyalkylene alkyl ether sulfates.

(Meth)acrylic polymers contain one or two hydrophilic monomers selected from: acrylic monomers such as (meth) acrylic acid, α-cyano acrylic acid, α-cyanomethacrylic acid, itaconic acid, crotonic acid, fumaric acid, maleic acid, and maleic acid anhydride; hydroxyl group-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester type monomers such as diethylene glycol monoacrylic acid ester, diethylene glycol monomethacrylic acid ester, glycerin monoacrylic acid ester, and glycerin monomethacrylic acid ester; vinyl alcohol type monomers such as N-methylol acrylamide, and N-methylol methacrylamide; vinyl alkyl ether type monomers such as vinyl methyl ether, vinyl ethyl ether, and vinyl propyl ether; vinyl alkyl ester type monomers such as vinyl acetate, vinyl propionate, and vinyl butyrate; aromatic vinyl type monomers such as styrene, α-methyl styrene, and vinyl toluene; amide type monomers such as acrylamide, methacrylamide, diacetone acrylamide, and methylol compounds thereof; nitrile type monomers such as acrylonitrile, and methacrylonitrile; acid chloride type monomers such as acrylic acid chloride, and methacrylic acid chloride; vinyl nitrogen-containing heterocyclic monomers such as vinyl pyridine, vinyl pyrrolidone, vinyl imidazole, and ethylene imine; and crosslinking monomers such as ethylene glycol dimethacrylate, diethylene glycol dimethacrylate, allyl methacrylate, and divinyl benzene.

Examples of polyoxyethylene type polymers include polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene lauryl phenyl ether, polyoxyethylene stearyl phenyl ester, and polyoxyethylene nonyl phenyl ester.

Examples of cellulose type polymers include methyl cellulose, hydroxyethyl cellulose, and hydroxypropyl cellulose.

Examples of polyoxyalkylene alkyl aryl ether sulfates include sodium polyoxyethylene lauryl phenyl ether sulfate, potassium polyoxyethylene lauryl phenyl ether sulfate, sodium polyoxyethylene nonyl phenyl ether sulfate, sodium polyoxyethylene oleylphenyl ether sulfate, sodium polyoxyethylene cetyl phenyl ether sulfate, ammonium polyoxyethylene lauryl phenyl ether sulfate, ammonium polyoxyethylene nonyl phenyl ether sulfate, and ammonium polyoxyethylene nonylphenyl ether sulfate.

Examples of polyoxyalkylene alkyl ether sulfates include sodium polyoxyethylene lauryl ether sulfate, potassium polyoxyethylene lauryl ether sulfate, sodium polyoxyethylene oleyl ether sulfate, sodium polyoxyethylene cetyl ether sulfate, ammonium polyoxyethylene lauryl ether sulfate, and ammonium polyoxyethylene oleyl ether sulfate. The water soluble polymeric dispersants may be used each alone or two or more kinds of them may be used in combination.

Before supplying the coarse powder slurry obtained in the preliminary pulverizing step S1 to the finely pulverizing step S2, a dispersant may be added to the coarse slurry powder. The step is referred to as "coarse powder slurry stabilizing step". Even when the dispersant is added in the state where the toner is in the coarse powder slurry, there is no possibility that bubbles are attached to the surface of the coarse toner powder to give undesired effect on the fine pulverization. While the addition amount of the dispersant is not particularly restricted, it is preferably from 0.05 to 10% by weight and, more preferably, from 0.1 to 3% by weight based on the total amount of water and the dispersant. Fine pulverization in the fine pulverizing step S2 proceeds smoothly by adding the dispersant in the range described above. Further, in a case of manufacturing the encapsulated toner, methanol is added preferably together with the dispersant. While the addition amount of methanol is not particularly restricted, it is preferably from 1 to 5% by weight based on the total amount of water and methanol. Mixing of the coarse powder slurry and the dispersant is conducted by using a usual mixer, to obtain a coarse powder slurry containing the dispersant. Mixing of the coarse powder slurry and the dispersant may be conducted either under heating, under cooling, or at a room temperature.

[Finely Pulverizing Step S2]

In the finely pulverizing step S2, the coarse powder slurry obtained in the preliminary pulverizing step S1 is passed under heating and pressure through the pressure resistant nozzle in which the coarse toner powder is further pulverized to prepare a fine powder slurry containing a fine toner powder with a smaller volume average particle size than that of the coarse toner powder and under a heated and pressurized state. The coarse powder slurry is a slurry without once passed through the pressure resistant nozzle, whereas the fine powder slurry is a slurry having passed through the pressure resistant nozzle at least once.

The pressing and heating conditions for the coarse powder slurry is not particularly restricted and it is preferable that the slurry is pressurized to 50 to 250 MPa and heated to 50° C. or higher and, more preferably, pressurized to 50 to 250 MPa and heated to 90° C. or higher and, particularly preferably, pressurized to 50 to 250 MPa and heated to 90 to Tm+25° C. (Tm: ½ softening temperature of flow tester). At a pressure lower than 50 MPa, the shearing energy is low and decrease in the particle size cannot possibly be attained sufficiently. in a case where the pressure exceeds 250 MPa, this is not practical since the danger increases excessively in the actual production line. The coarse powder slurry is introduced from an inlet of the pressure resistant nozzle to the inside of the pressure resistant nozzle at the pressure and the temperature within the range described above. The pressure resistant nozzle may be disposed by one or in plurality. It is preferably disposed in plurality. In a case of disposing a plurality of the pressure resistant nozzles, it is preferably by the number of about 2 to 10. Further, the pressure resistant nozzle may be disposed by the number of one and the fine powder slurry may be passed through the pressure resistant nozzle repetitively. In this case, the number of passing through the pressure resistant nozzle is preferably about 2 to 10 times.

Figure 3:
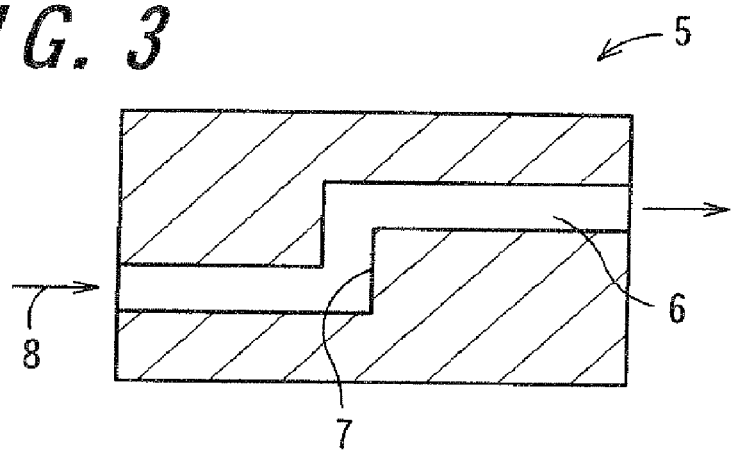
FIG. 3 is a longitudinal cross sectional view schematically showing the constitution of a pressure resistant nozzle.

While general pressure resistant nozzles capable of passing liquid can be used as the pressure resistant nozzle, a multi-nozzle having a plurality of liquid paths can be used preferably. The liquid paths of the multi-nozzle can be arranged concentrically with the axial line of the multi-nozzle as a center, or a plurality of liquid paths are formed substantially in parallel in the longitudinal direction of the multi-nozzle. An example of the multi-nozzle used in the manufacturing method according to the invention includes those in which each liquid paths has an inlet diameter and the outlet diameter of about 0.05 to 0.35 mm and the length of 0.5 to 5 cm are formed by one or in plurality, preferably, by about 1 to 2. Further, a pressure resistant nozzle 5 shown in FIG. 3 can also be used. FIG. 3 is a longitudinal cross sectional view schematically showing the constitution of a pressure resistant nozzle 5. The pressure resistant nozzle 5 has a liquid path 6 at the inside thereof. The liquid path 6 is bent in a hook-like shape and it has at least one collision wall 7 to be hit by a slurry containing a coarse toner powder and intruding into the path from the direction of an arrow 8. The slurry containing the coarse toner powder collides against the colliding wall 7 substantially at a normal angle, by which the fine toner powder is pulverized into the coarse toner powder with a smaller volume average particles than that of the coarse toner powder and discharged out of the pressure resistant nozzle 5.

The slurry discharged from the outlet of the pressure resistant nozzle contains a fine toner powder with a volume average particle size, for example, of about 0.4 to 3.0 μm and it is heated to 60 to Tm+60° C. (Tm is identical with that described above) and pressurized to about 10 to 50 MPa.

In the present specification, the volume average particle size and the coefficient of variation (CV value) are values determined as described below. A sample for measurement was prepared by adding 20 mg of a sample and 1 ml of sodium alkyl ether sulfate ester to an electrolyte (trade name: ISOTON-II, manufactured by Beckman Coulter Co.) 50 ml and put to a dispersing treatment by a supersonic disperser at a supersonic frequency of 20 kHz for 30 min. The sample used for measurement was measured by a particle size distribution measuring apparatus (trade name: Multisizer 2, manufactured by Beckman Coulter Co.) under the conditions at an aperture diameter of 100 μm, the number of particles measured: 50,000 counts, and the volume average particle size and the standard deviation in the volume particle size distribution were determined based on the volume particle size distribution of the sample particles. The coefficient of variation (CV value, %) was calculated according to the following equation.

$$CV\text{ value }(\%)=(\text{Standard deviation in the volume particle size distribution}/\text{Volume average particle size})\times 100$$

[Cooling Step S3]

In the cooling step S3, the fine powder slurry in a heated and pressurized state obtained in the finely pulverizing step S2 is cooled. Specifically, a fine powder slurry discharged from the pressure resistant nozzle in the finely pulverizing step S2 is cooled by introduction into a liquid cooler. While the cooling temperature is not restricted, when it is cooled to a liquid temperature of 30° C. or lower as a measure, the pressure applied to the slurry is decreased to about 5 to 80 MPa.

Known liquid coolers can be used and, among all, a liquid cooler with a large cooling area such as a corrugated tube type cooler is preferred. Further, it is preferable that the liquid cooler is configured such that the cooling gradient is decreased (or the cooling performance is lowered) from an inlet of the cooler to an outlet of the cooler. This can more efficiently attain the refinement of the wax, uniform dispersion of the refined wax in the toner particles, etc. Further, this can prevent growing of the fine toner powder due to reattachment to each other and can improve the yield of toner particles with decreased size. One or plurality of coolers may be disposed.

The fine powder slurry discharged from the pressure resistant nozzle in the finely pulverizing step S2 is introduced, for examples from the inlet of the cooler to the inside of the cooler, undergoes cooling in the inside of the cooler having the cooling gradient and is then discharged from the outlet of the cooler.

[Depressurizing Step S4]

In the depressurizing step S4, the pressure applied to the fine powder slurry obtained in the cooling step S3 is reduced to such an extent of pressure as causing no bubbling (occurrence of bubbles). The fine powder slurry supplied from the cooling step S3 to the depressurizing step S4 is in a state pressurized to about 5 to 80 MPa. In the depressurizing step, it is preferred to operate so that pressure is reduced gradually stepwise. For the depressurizing operation, a multistage depressurization apparatus described in WO03/059497 is used preferably.

The multistage depressurization apparatus has an input channel, an output channel and a multistage depressurizing section. The input channel introduces a pressurized fine powder slurry into the multistage depressurization apparatus. The output channel is disposed so as to be in communication with the input channel and discharges the depressurized fine powder slurry to the outside of the multistage depressurization apparatus. The multistage depressurizing section is disposed between the input channel and the output channel and includes two or more depressurizing members and a connection member for connecting the depressurizing members. Adjacent depressurizing members are connected by way of a connection member. The depressurizing member includes, for example, a pipe-like member. The connection member includes, for example, a ring-shape seal. The multistage depressurizing section is constituted by connecting a plurality of pipe-like members of different inner diameters by the ring-shaped seal. For example, the fine powder slurry flowing in the pipe-like member is gradually depressurized and, finally, depressurized to such a level as causing no bubbling, preferably, to an atmospheric pressure by connecting the pipe-like members having an identical inner diameter by the number of 2 to 4 from the input channel to the output channel, then connecting a pipe-like member having an inner diameter larger by about twice than them by the number of one and, further, by connecting pipe-like members having an inner diameter smaller by about 5 to 20% then the pipe-like member having a larger inner diameter by about twice by the number of 1 to 3. The multistage depressurization apparatus may be disposed by the number of one or in plurality. A heat exchange section using a cooling medium or heating medium may be disposed around the multistage depressurizing section to conduct cooling or heating depending on the value of the pressure added to the fine powder slurry.

The discharge port of the cooler in the cooling step S3 and the receiving port of the input channel of the multistage depressurization apparatus in the depressurizing step S4 are connected by a pressure resistant pipeline. By providing a supply pump and a supply valve on the pressure resistant pipeline, the fine powder slurry is introduced from the cooling step S3 to the input channel of the multistage depressurization apparatus in the depressurizing step S4.

Figure 4:
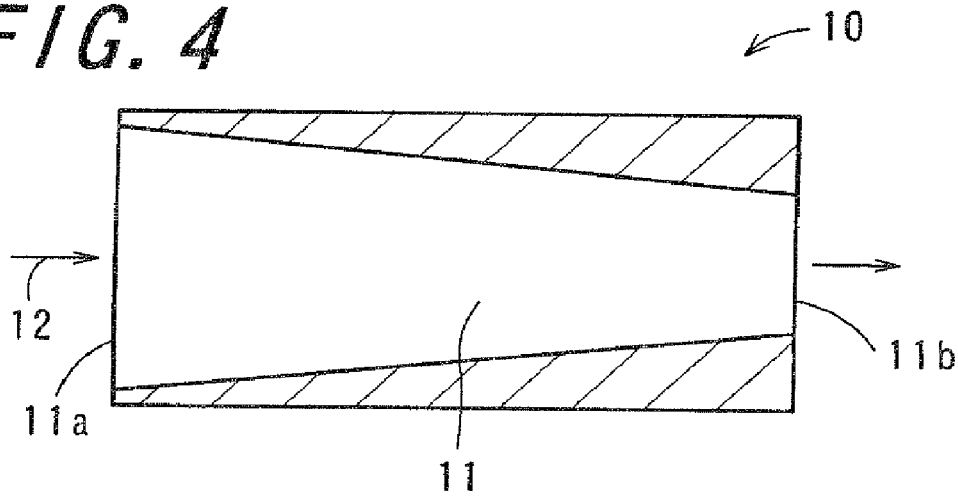
FIG. 4 is a longitudinal cross sectional view schematically showing the constitution of a depressurizing nozzle.

In the manufacturing method according to the invention, the depressurizing nozzle 10 shown in FIG. 4 may be used as the depressurizing device. FIG. 4 is a longitudinal cross sectional view schematically showing the constitution of the depressurizing nozzle 10. In the depressurizing nozzle 10, a flow channel 11 is formed penetrating the inside thereof in the longitudinal direction. The fine powder slurry is introduced from an inlet 11*a* of the flow channel 11 to the inside of the flow channel 11 and discharged from an outlet 11*b* of the flow channel 11 to the outside of the flow channel 11. The flow channel 11 is formed such that the inlet diameter is larger than the outlet diameter. Further, in the flow channel 11, the cross section in the direction perpendicular to the direction of an arrow 12 which is a flowing direction of the fine powder slurry is gradually decreased as it approaches from the inlet 11*a* to the outlet 11*b*, and the center line (axial line) for the cross section is present on an identical axial line (axial line for the depressurizing nozzle 10) in parallel with the direction of the arrow 12. According to the depressurizing nozzle 10, the coarse powder slurry in the pressurized and heated state is introduced from the inlet 11*a* into the flow channel 11, depressurized and is then discharged from the outlet 11*b*. One or a plurality of such depressurizing nozzles 10 can be provided. In a case of providing the plurality of nozzles, they may be disposed in series or in parallel.

In the cooling step S3 and the depressurizing step S4, the fine toner powder is properly aggregated and fused to each other to form toner particles decreased in the particle size. Accordingly, the slurry after the completion of the depressurizing step S4 mainly contains small-sized toner particles. The small-sized toner particles are isolated out of the slurry by usual separation section such as filtration and centrifugation and, optionally, washed with pure water or ionized water, and dried and classified to obtain a small-sized toner according to the invention with a particle size of about 3.5 to 6.5 μm.

Further, in the manufacturing method according to the invention, an aggregating and pulverizing step may be interposed between the finely pulverizing step S2 and the cooling step S3. By providing the aggregating and pulverizing step, in the toner according to the invention obtained as aggregates of the fine toner powder, its shape is made further uniform, a particle size distribution width is further narrowed, and the charging property is made more uniform. In the aggregating and pulverizing step, the fine toner powder is aggregated by generating a swirl in the fine powder slurry obtained in the fine pulverizing step S2, and the aggregates of the obtained fine toner powder are pulverized to conduct particle size control for the aggregates. The method of generating swirl in the fine powder slurry includes, for example, a method of passing the fine powder slurry under pressure and heating through a coiled pipeline.

The fine powder slurry is heated, preferably, to a temperature from the glass transition temperature of the fine toner powder to the softening temperature (° C.) of the fine toner powder and, more preferably, from 60 to 90° C. and pressurized to a pressure, preferably, from 5 to 100 MPa, and more preferably, 5 to 20 MPa. In a case where the heating temperature is lower than the glass transition temperature of the fine toner powder, aggregation of the fine toner powder less occurs to possibly lower the yield of aggregated particles. In a case where the heating temperature exceeds the softening temperature of the fine toner powder, excessive aggregation occurs thereby making the control for the particle size difficult. In a case where the pressure is lower than 5 MPa, the fine powder slurry cannot be passed smoothly in the coiled pipeline. In a case where the pressurizing pressure exceeds 100 MPa, aggregation of the fine toner powder occurs scarcely.

The coiled pipeline for flowing the fine powder slurry is a member comprising a pipe-like pipeline having a flow channel in the inside which is wound in a coiled configuration or spirally. The number of turns for the coil of the coiled pipeline is, preferably, from 1 to 200, more preferably, from 5 to 80 and, particularly preferably, from 20 to 60. In a case where the number of coil turns is less than 1, the fine toner powder is not aggregated but aggregated particles grown from aggregates to an appropriate particle size are further aggregated to form coarse particles. In a case where the number of coil turns exceeds 200, since the time of adding a centrifugal force is made longer, the particle size control is difficult. As a result, the yield of aggregated particles having an appropriate particle size is lowered. In a case where the number of coil turns is within a range from 20 to 60, particle size control is particularly easy and aggregated particles of uniform shape and particle size can be obtained in a good yield. Further, while the coil radius in one coil is not particularly restricted, it is preferably from 25 to 200 mm and, particularly preferably, from 30 to 80 mm. In a case where the coil radius is less than 25 mm, an angular velocity becomes predominant in the flow channel of the coiled pipeline and the fine toner powder tends to be localized stably to the inner wall surface and the vicinity thereof of the flow channel. As a result, excessive aggregation of the fine toner powder tends to occur thereby making the particle size control difficult and the yield of aggregated particles having an appropriate particle size is lowered. In a case where the coil radius exceeds 200 mm, the centrifugal force increases in the flow channel, where turbulence less occurs, the possibility that the fine toner powder collide against each other is decreased and aggregation of the fine toner powder less occurs. Accordingly, particle size control is difficult and the yield of the aggregated particles having an appropriate particle size is lowered.

The reason for the occurrence of aggregation by the pass of the fine powder slurry in a heated and pressurized state through the coil pipeline has not yet been apparent sufficiently, but it may be considered as below. The fine powder slurry flows in the flow channel of a linear pipeline while forming a laminar flow. In the laminar flow, particles of a large particle size flow substantially in alignment at the center of the flow channel, particles of small particle size flow substantially in alignment near the inner wall surface of the flow channel. In this case, since there is no disturbance in the flow, particles less collide against each other and aggregation scarcely occurs. On the other hand, when the fine powder slurry is introduced into the flow channel of the pipe-like pipeline, a centrifugal force directing to the outside of the flow channel increases near the inner wall surface of the flow channel. To the contrary, at the center of the flow channel, turbulence (swirl) is generated by the application of the centrifugal force and the shearing force. Particles of large particle size are gathered by a centrifugal force near the inner wall surface of the flow channel and, since the centrifugal force is strong, they flow substantially in alignment without showing irregular behavior in which particles less collide against each other and aggregation less occurs. On the other hand, particles of small particle size (or mass) such as a fine toner powder pass the central portion of the flow channel while being involved in the swirl and, accordingly, the number of collision between each of the particles increases to frequently cause aggregation. Then, when the aggregated particles grow into an appropriate size, since the aggregated particles move near the inner wall surface of the flow channel by the centrifugal force, excessive aggregation less occurs also at the central portion. Further, even when some particles grow into coarse particles, they are pulverized into aggregated particles of an appropriate particle size, for example, by collision between particles to each other and collision with the inner wall surface of the flow channel. As described above, only the fine toner powder can be aggregated substantially selectively.

In the aggregating and pulverizing step, a cationic dispersant may be added to the fine powder slurry. By the addition of the cationic dispersant, dispersibility of the fine toner powder in the fine powder slurry is lowered. When the fine powder slurry passes through the pipe-like pipeline in this state, aggregation of the fine powder toner proceeds smoothly with no trouble to obtain aggregated particles with less scattering in the shape and the particle size. That is, in the invention, the cationic dispersant serves as a flocculant. While known cationic dispersants can be used, preferred are alkyl trimethyl ammonium type cationic dispersant, alkylamide amine type cationic dispersant, alkyldimethyl benzyl ammonium type cationic dispersant, cationized polysaccharide-type cationic dispersant, alkyl betaine type cationic dispersant, alkylamide betaine type cationic dispersant, sulfobetaine type cationic dispersant, amineoxide type cationic dispersant, etc. Among them, the alkyltrimethyl ammonium type cationic dispersant is further preferred. Specific examples of the alkyl trimethyl ammonium type cationic dispersant includes, for example, stearyl trimethyl ammonium chloride, tri(polyoxyethylene) stearyl ammonium chloride, and lauryl trimethyl ammonium chloride. The cationic dispersants may be used each alone or two or more kinds of them may be used in combination. The cationic dispersant is used, for example, being added to a mixed slurry. While the addition amount of the cationic dispersant is not particularly restricted and the addition amount can be selected properly from a wide range, it is preferably from 0.1 to 5% by weight based on the entire amount of the fine powder slurry. In a case where the addition amount is less than 0.1% by weight, the performance of weakening the dispersibility of the fine toner powder becomes insufficient to possibly make aggregation of the fine toner powder insufficient. In a case where the addition amount exceeds 5% by weight, the dispersing effect of the cationic dispersant develops thereby possibly making the aggregation insufficient.

Further, in the aggregating and pulverizing step, an anionic dispersant may also be added together with the cationic dispersant to the fine powder slurry. The anionic dispersant is preferably added to the fine powder slurry in a case where the synthetic resin as the matrix ingredient of the fine toner powder is a resin other than the self-dispersible resin. The anionic dispersant improves the dispersibility of the fine toner powder in water. Accordingly, by adding the anionic dispersant to the fine powder slurry and further adding the cationic dispersant, aggregation of the fine toner powder proceeds smoothly and occurrence of excessive aggregation is prevented, and aggregated particles with a narrow distribution width can be manufactured in a good yield. The anionic dispersant may also be added to the coarse powder slurry in a state of preparing the coarse powder slurry. Known anionic dispersants can be used and they include, for example, sulfonic acid type anionic dispersant, sulfate ester type anionic dispersant, polyoxyethylene ether type anionic dispersant, phosphate ester type anionic dispersant, and polyacrylate salt. As specific examples of the anionic dispersant, sodium dodecyl benzene sulfonate, sodium polyacrylate, polyoxyethylene phenyl ether, etc. can be used preferably. The anionic dispersants may be used each alone, or two or more kinds of them may be used in combination. While the addition amount of the anionic dispersant is not particularly restricted, it is preferably from 0.1 to 5% by weight based on the entire amount of the fine powder slurry. In a case where it is less than 0.1% by weight, the dispersing effect for the fine toner powder by the anionic dispersant become insufficient to possibly cause excessive aggregation. In a case where it is added in excess of 5% by weight, the dispersing effect is no more improved and, rather, the dispersibility of the fine toner powder is lowered by the increase in the viscosity of the fine powder slurry. As a result, excessive aggregation may possibly occur. Further, while the ratio of use between the cationic dispersant and the anionic dispersant is not particularly restricted, and this is not particularly restricted so long as they are used at a ratio of lowering the dispersing effect of the anionic dispersant by the use of the cationic dispersant. However, considering the easy particle size control for the aggregated particles, easy occurrence of aggregation, prevention for the occurrence of excessive aggregation, and further narrowing of the particle distribution width of the aggregated particles, it is preferable that the anionic dispersant and the cationic dispersant are used, preferably, at 10:1 to 1:10, more preferably, 10:1 to 1:3 and, particularly preferably, 5:1 to 1:2 by weight ratio.

Figure 5:
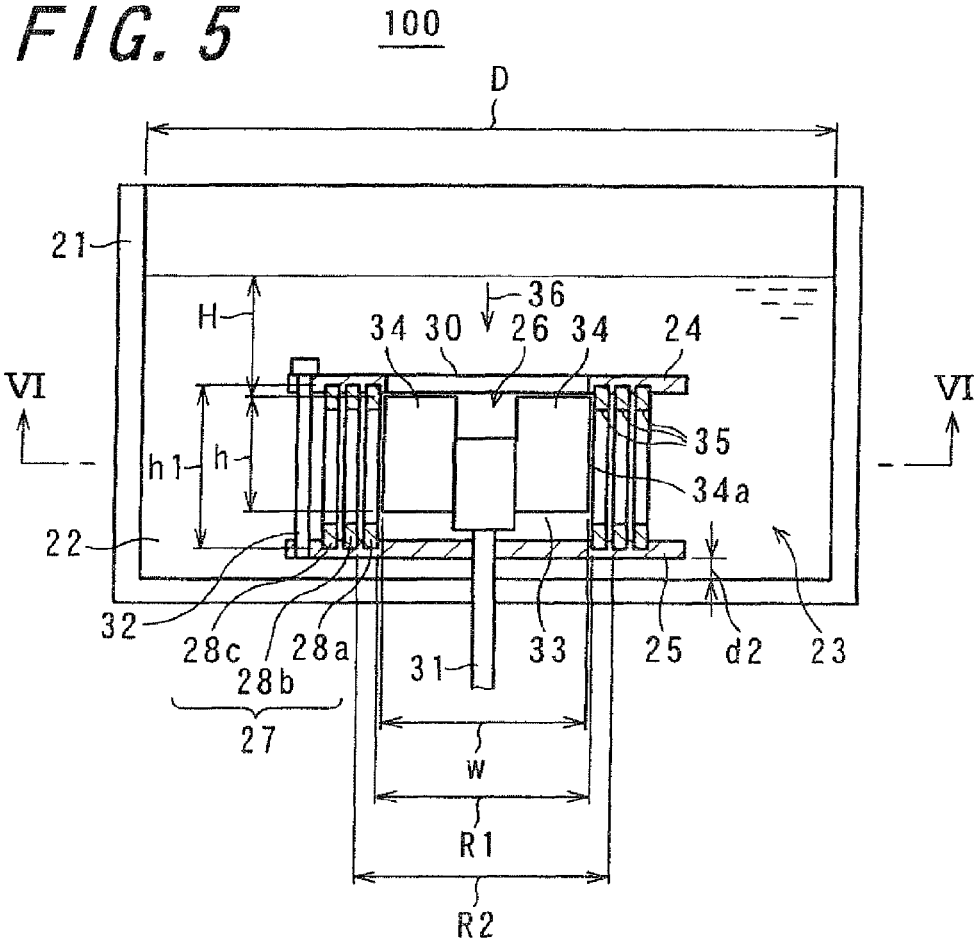
FIG. 5 is a cross sectional view schematically showing the constitution of a granulation apparatus.
Figure 6:
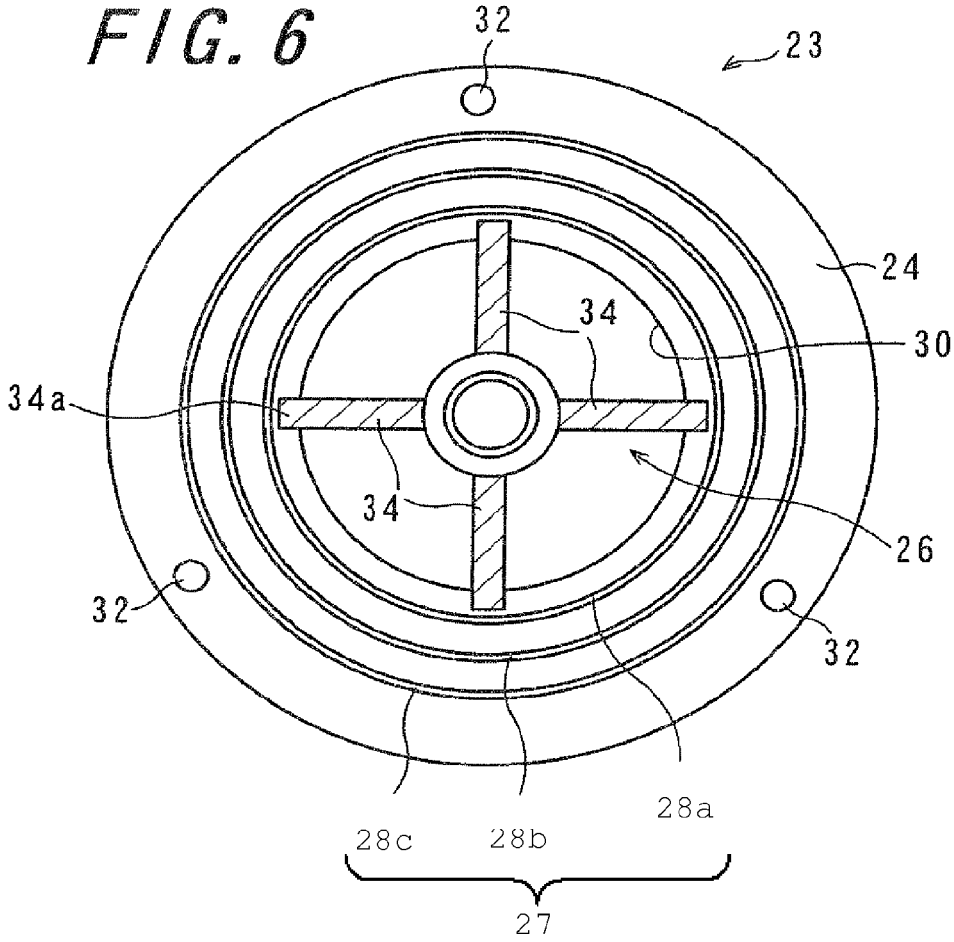
FIG. 6 is a cross sectional view showing a stirring section included in a granulation apparatus along the line VI-VI.

Further, in the manufacturing method according to the invention, the aggregating step may be conducted after the depressurizing step S4. By the provision of the aggregating step, in the toner according to the invention obtained as the aggregates of the fine toner powder, its shape is made further uniform, the particle size distribution width is further narrowed, and the charging property is made more uniform. In the aggregating step, the fine powder slurry obtained in the depressurizing step S4 is treated to aggregate the fine toner powder contained in the fine powder slurry by using the granulation apparatus including a container, a stirring section and a plurality of screen members. The container contains the fine powder slurry. The stirring member is disposed in the container and stirs the fine powder slurry contained in the container. The screen member is disposed so as to surround the stirring member and formed with a plurality of fine powder slurry passing holes that penetrate in the direction of the thickness. A specific example of the granulation apparatus includes a granulation apparatus 100 shown in FIG. 5. FIG. 5 is a cross sectional view schematically showing the constitution of the granulation apparatus 100. FIG. 6 is a cross sectional view showing a stirring section 3 included in the granulation apparatus 100 along the line VI-VI. The granulation apparatus 100 includes a stirring container 21, a stirring section 23, and a screen member 27.

The stirring container 21 is a cylindrical bottomed container member opened upward vertically and contains a fine powder slurry 22. In this embodiment, the stirring container 21 is an open type batch container. Further, in this embodiment, an inner diameter D of the stirring container 21 is 10.5 cm. While the open type batch container is used as the stirring container 21 in this embodiment, this is not restrictive but a closed continuous type (inline type) through-flow container may also be used. The stirring container 21 is heated by a heating section (not shown) thereby heating the fine powder slurry 22 to a liquid temperature of from 60 to 100° C.

The stirring section 23 is disposed in the stirring container 21. When the fine toner powder in the fine powder slurry 22 is aggregated, the stirring section 23 of this embodiment stirs the fine powder slurry 22 contained in the stirring container 21 under high speed rotation thereby making the particle size of the aggregated particles as the aggregates of the fine toner powder uniform. The stirring section 23 includes a first cover plate 24, a second cover plate 25, and an impeller 26.

The first cover plate 24 is a disk-like member in which a circular slurry in-flow hole 30 that penetrates in the direction of the thickness and has a diameter smaller than the inner diameter of the first screen member 28*a* to be described later is formed at the central portion of the disk. Three bolt holes (not shown) are formed in the circumferential direction near the circumferential edge of the first cover plate 24. Three circular concaves extending in the circumferential direction of the first cover plate 24 are formed each at an identical distance on one surface of the first cover plate 24 in the direction of the thickness. By fitting axial one end for each of the first, second and third screen members 28*a*, 26*b* and 28*c* having substantially cylindrical shape into the concave portion, the first, second and third screen members 28*a*, 28*b* and 28*c* are supported by the first cover plate 24.

The second cover plate 25 is a disk-like member having an outer diameter equal to that of the first cover plate 24 and a shaft hole (not shown) for passing through the rotary shaft 31 of the impeller 26 is formed at the central portion of the disk. Three bolt holes (not shown) are formed circumferentially near the peripheral edge of the second cover plate 25 like in the first cover plate 24. Further, three circular concave portions extending in the circumferential direction of the second cover plate 25 are formed each at an identical distance on the surface of the second cover plate 25 facing the first cover plate 24 in the direction of the thickness. By fitting the other axial ends for each of the first, second and third screen members 28*a*, 28*b* and 28*c* having a cylindrical shape into the concave portions, the first, second and third screen members 28*a*, 28*b* and 28*c* are supported by the second cover plate 25.

The first cover plate 24 and the second cover plate 25 are connected by three bolts 32 that are fitted into or screwed with the bolt holes, respectively, and are spaced apart by a predetermined distance in the direction of a central axis for the first cover plate 24 and the second cover plate 25. This forms an inter-plate space 33 between the first cover plate 24 and the second cover plate 25.

The impeller 26 is a high speed rotational type stirring member that stirs the fine powder slurry 22 in the stirring container 21 and includes a rotary shaft 31 and stirring blades 34. The impeller 26 is disposed such that the central axial line for the slurry flow hole 30 and the axial line for the rotary shaft 31 are aligned. Further, in this embodiment, the impeller 26 is disposed such that the extending direction of the axial line for the rotary shaft 31 is substantially aligned with the vertical direction. The rotary shaft 31 is disposed such that it can be driven rotationally about an axis thereof by a driving section (not shown). The driving section includes, for example, a motor and a power source for supplying a driving power to the motor. The stirring blades 34 are composed of four rectangular plate members which are opposed to each other with respect to the rotary shaft 31 and supported by the rotary shaft 31, and rotates accompanying the rotation of the rotary shaft 31. The stirring blades 34 are disposed so as to extend radially from a portion supported by the rotary shaft 31 in an imaginary with the axial line of the rotary shaft 31 as a center, respectively. Further, the stirring blades 34 are disposed such that the end faces 34*a* on the side opposite to the side supported by the rotary shaft 31 of the stirring blades 34 faces the inner wall surface of the screen member 28*a* and is spaced apart with a gap to the inner wall surface. Further, in this embodiment, the lateral size W from the end face 34*a* in one stirring blade 34 to one end face 34*a* of the stirring blade 34 opposed to the stirring blade 34 with respect to the rotary shaft 31 is 2.4 cm. Further, the length (size for height) h of the stirring blade 34 in the vertical direction (longitudinal direction) is 1.3 cm. While the lateral size W and/or height size h are properly decided depending on the size of the stirring container 21, etc., the lateral size W is preferably from ⅙ to ⅓ of a diameter of the inner bottom surface in the stirring container 21. A tip speed of the stirring blade 14 (hereinafter referred to as "a stirring blade tip speed") is preferably selected properly depending on the kind of the toner raw material contained in the fine toner powder in the fine powder slurry 22, the amount of the fine powder slurry 22, the size of the stirring container 21, etc. By setting the stirring blade tip speed in a proper range, the resin slurry 2 can be stirred so that aggregation of the fine toner powder property proceed while suppressing growing of the fine toner powder due to excessive aggregation by decreasing the generation amount of the bubbles.

The screen members 27 are disposed so as to surround the impeller 26. This can prevent generation of a swirl in the fine powder slurry 22 contained in the stirring container 21 and prevent the fine powder slurry 22 from involving air. That is, macro bubbles which are large air bubbles formed by continuous involvement of a gas phase in contact with the liquid are not generated, and the amount of air involved by the rotation of the rotation of the impeller 26 can be decreased. As a result, excessive aggregation of the fine toner powder and incorporation of the bubbles to aggregated particles can be prevented to obtain a toner as aggregated particles with a narrow particle size distribution width and high physical strength. Further, by providing the screen member 27, generation of the swirl can be prevented and increase in the incorporation amount of the bubbles due to increase in the rotational speed does not occur. Accordingly, the rotational speed of the impeller 26 can be decided with no consideration for the mixing of bubbles. Since this can increase the shearing force that can be provided from the impeller 26 to the fine powder slurry 22, aggregated particles further decreased in size and with narrow particle size distribution width can be obtained.

The screen member 27 includes, the first, second and third screen members 28*a*, 28*b* and 28*c*. The three screen members 28*a*, 28*b* and 28*c* are cylindrical members of different diameters and the inner diameter of the first screen member 28*a* is smallest, and the inner diameter of the third screen member 28*c* is largest. Further, when the screen members 28*a*, 28*b* and 28*c* are arranged such that their respective axial lines are aligned with each other, they are in such a relationship for the size of the inner diameter that the outer circumferential surface of the first screen member 28*a* and the inner circumferential surface of the second screen member 28*b* are spaced apart and the outer circumferential surface of the second screen member 28*b* and the inner circumferential surface of the third screen member 28*c* are spaced apart when the screen members 28*a*, 28*b* and 28*c* are arranged such that their respective axial lines are aligned with each other. Further, one end in the vertical direction of each of the first, second and third screen members 28*a*, 28*b* and 28*c* are fitted into the circular concave portions formed in the second cover plate 25 respectively. Further, respective other end portions in the vertical direction thereof are fitted into the circular concave portions formed to the first cover plate 24. Thus, the first, second and third screen members 28*a*, 28*b* and 28*c* are supported by the first cover plate 24 and the second cover plate 25.

The first screen member 28*a* is a cylindrical member having an inner diameter slightly larger than the lateral size W in the impeller 26 and extending in the vertical direction and is disposed so as to surround the impeller 26 in the inter-plate space portion 33. In this embodiment, the first screen member 28*a* has an inner diameter R1 of 2.7 cm, and a height h1 in the vertical direction of 2.5 cm. Further, the first screen member 28*a* is formed with a plurality of slits 35 that extending in the vertical direction while penetrating the circumferential surface in the direction of the thickness. The fine powder slurry 22 flows through the slit 35 from the inside to the outside of the first screen 27*a*, and vice versa. The width in the circumferential direction and the length in the vertical direction of the slit 35 and the gap in the circumferential direction between each of the adjacent slits 35 are properly decided depending, for example, on the particle size of the aggregated particles to be obtained. For example, in order to obtain aggregated particles with the volume average particle size of 3 μm to 6 μm, the slit 35 is formed such that the width is 2 mm, the length is 17 mm, and the distance is 3 mm.

The second screen member 28*b* is a cylindrical member having an inner diameter larger than the first screen member 28*a* and extending in the vertical direction and is disposed so as to surround the first screen member 28*a* in the inter-plate space 33. In this embodiment, the inner diameter R2 of the second screen member 28*b* is 3.7 cm, and the height of the second screen member 28*b* in the vertical direction is 2.5 cm which is identical with the height h1 of the first screen member 28*a*. Further, the second screen member 28*b* is formed with a plurality of slits 35 extending in the vertical direction while penetrating the circumferential surface in the direction of the thickness. The slit 35 functions in the same manner as the slit 35 in the first screen member 28*a*.

The third screen member 28*c* is a cylindrical member having an inner diameter larger than the outer diameter of the second screen member 28*b* and extending in the vertical direction and is disposed so as to surround the second screen member 28*b* in the inter-plate space 33. In this embodiment, the inner diameter R3 of the third screen member 28*c* is 4.6 cm and the height of the third screen member 28*c* in the vertical direction is 2.5 cm which is identical with the height h1 of the first screen member 28*a*. Further, the third screen member 28*c* is formed with a plurality of slits 35 extending in the vertical direction while penetrating the circumferential surface in the direction of the thickness. The slit 35 functions in the same manner as the slit 35 in the first screen member 28*a*.

While the three screen members 28*a*, 28*b* and 28*c* are disposed in this embodiment, they are not restrictive but two or more screen members may be disposed. In a case where one screen member is disposed, a swirl is generated in the fine powder slurry 22 due to stirring at high speed rotation by the stirring section 23, the amount of air incorporated in the fine powder slurry 22 is increased to give undesired effects on the formation of the aggregated particles. For decreasing the amount of air involved by the rotation of the impeller 26, two or more screen members are necessary. Further, it is preferable that three or more of screen members are provided for reliably preventing mixing of bubbles to the aggregated particles.

The stirring section 23 is placed on the bottom of the stirring container 21 and used in a state of being immersed in the fine powder slurry 22 contained in the stirring container 21. A position where the stirring section 23 is placed on the bottom of the stirring container 21 is properly selected depending on the kind of the toner raw material contained in the fine toner powder in the fine powder slurry 22, the amount of the fine powder slurry 22, the size of the stirring container 21, etc. By the selection for the position to be placed, the particle size distribution width of the toner as aggregated particles to be formed can be narrowed, and the generation amount of bubbles can be decreased. The position for placing the stirring section 23 is decided by properly setting the ratio of the distance H between a liquid level of the fine powder slurry 22 in the stirring container 21 and the upper end of the stirring blade 34 on the side facing the first cover plate 24 and the inner diameter D of the stirring container 21, i.e., H/D, and properly setting the distance d1 between the bottom of the stirring container 21 and the surface of the second cover plate 25 on the side opposite to the side facing the first cover plate 24. The stirring section 23 is not restricted to that of this embodiment, but commercial products and those described in the patent documents can be used. As the commercial products of the stirring section 23, for example, New Generation Mixer NGM-1.5TL (trade name, manufactured by Beryu Co., Ltd.). Further, stirring sections described in patent documents include those as described in Japanese Unexamined Patent Publication JP-A 2004-3893.

When the impeller 26 of the stirring section 23 rotates in a state where the fine powder slurry 22 is contained in the stirring container 21, the fine powder slurry 22 present above the slurry in-flow hole 30 flows through the slurry in-flow hole 30 in the direction of an arrow 36 and flows into the inter-plate space section 33. Further, the fine powder slurry 22 on the side inner to the first screen member 28*a* is discharged by the rotation of the impeller 26 to the radial outside of an imaginary circle present in a plane perpendicular to the rotary axis of the impeller 26 with the rotary axis 31 of the impeller 26 as a center. The discharged fine powder slurry 22 passes through the slit 35 of the first screen member 28*a*, the slit 35 of the second screen member 28*a*, and the slit 35 of the third screen member 28*c* successively and flows out from the inter-plate space 33. The fine powder slurry 22 flowing out of the inter-plate space portion 33 does not contain a flow component in the circumferential direction of an imaginary circle present in a plane perpendicular to the rotary shaft of the impeller 26. Accordingly, when the fine powder slurry 22 flows out radially from the stirring section 23 outward in the radial direction and collides against the inner wall surface of the stirring container 21, no swirl is generated in the fine powder slurry 22.

In the granulation apparatus 100, since the height of a wave of the fine powder slurry 22 generated by the stirring section 23 can be from 0 to 15 mm, the generation amount of the bubbles, that is, the intrusion amount of air into the aggregated particles can be decreased. The height for the wave of the fine powder slurry 22 is a distance in the vertical direction between the liquid surface of the fine powder slurry 22 and the nearest portion to the liquid surface of the fine powder slurry 22 at a portion generating no bubbles. The distance can be measured by using, for example, a ruler. Generation of the bubbles can be recognized by observing the liquid surface of the fine powder slurry 22. In a case where the bubbles are not generated at all, the height for the wave is 0 mm. According to the granulation apparatus 100, by stirring the fine powder slurry 22 contained in the stirring container 21 at a high speed rotation, when the fine powder slurry 22 passes through the slits 35 of the first to third screen members 28*a*, 28*b* and 28*c*, a shearing force is provided to the fine powder slurry 22. This can prevent the fine toner powder from excessive aggregation and a toner according to the invention as aggregated particles of small particle size with a small particle size distribution width can be obtained. While one of the aggregating and pulverizing step and the aggregating step is conducted usually, both of them may be conducted.

In the aggregating step, a flocculant is preferably added to the fine powder slurry 22 upon rotational stirring of the fine powder slurry 22 by the granulation apparatus 100. The flocculent includes, for example, monovalent salts, bivalent salts, and trivalent salts. Examples of the monovalent salts include a cationic flocculant such as alkyl trimethyl ammonium chloride, chlorides of alkali metals such as sodium chloride and potassium chloride, and chlorides such as ammonium chloride. Examples of the bivalent salts include magnesium chloride, calcium chloride, zinc chloride, cupric chloride (II), magnesium sulfate, and manganese sulfate. Examples of the trivalent salts include aluminum chloride, iron chloride (III), etc. Among them, alkyl trimethyl ammonium chloride is preferred. Specific examples of the alkyl trimethyl ammonium chloride include stearyl trimethyl ammonium chloride, tri (polyoxyethylene)stearyl ammonium chloride, and lauryl trimethyl ammonium chloride. While the addition amount of the flocculant is not particularly restricted, it is preferably from 0.1 to 5 parts by weight based on 100 parts by weight of the fine powder slurry. In a case where the addition amount of the flocculant is less than 0.1 parts by weight, the performance of weakening the dispersibility of the fine toner powder is insufficient to possibly render the aggregation of the fine toner powder insufficient. In a case where the addition amount of the flocculant exceeds 5 parts by weight, since the flocculant starts to develop the dispersing effect, not the aggregating effect, this may also possibly render aggregation insufficient.

After the completion of the depressurizing step S4 or after the completion of the aggregating step in a case where the aggregating step is conducted, the manufacturing method according to the invention is completed to reach end S5. At end S5, a toner according to the invention is obtained by isolating the aggregated particles from the slurry obtained by the depressurizing step S4 or the aggregating step. The aggregated particles can be isolated in the same manner as the usual wet type toner manufacturing method. For example, the toner according to the invention is obtained by separating aggregated particles from the slurry and cleaning and drying them. For the separation of the aggregated particle, general solid-liquid separation method can be used. The solid-liquid separation includes, for example, filtration, centrifugation, and decantation. Cleaning is conducted for removing unnecessary matters such as unaggregated fine Loner powder and dispersant. For example, a procedure of mixing the aggregated particles and water and separating the aggregated particles from the mixture may be conducted repetitively in accordance with the degree of removing unnecessary portions. As water used herein, water with extremely low impurity content is preferred, which is, for example, pure water at a conductivity of 20 μmS/cm. In a case of using the pure water, the procedures described above may be conducted repetitively till the conductivity of water left after separating the aggregated particles from the mixture of the aggregated particles and water till the conductivity is decreased to 50 μmS/cm or lower. After cleaning, drying is conducted. For drying, a general drying method can be used and includes, for example, a gas stream drying method, vacuum drying method, or spontaneous drying method. According to the invention, a toner decreased in size to about 3.5 to 6.5 μm particle size, with the particle size distribution width being narrower than the existent toner and of uniform shape can be manufactured easily.

For the toner particles manufactured as described above, an external additive having a function, for example, of improving the powder fluidity, improving the triboelectricity, heat resistance, improving the long time storability, improving the cleaning property, and controlling the surface abrasion property of the photoreceptor. The external additive includes, for example, line silica powder, fine titanium oxide, and fine alumina powder. The external additives may be used each alone, or two or more kinds of them may be used in combination. The addition amount of the external additives is preferably 0.1 part by weight or more and 10 parts by weight or less based on 100 parts by weight of the toner particles while considering the charging amount necessary for the toner, the effect on the friction of the photoreceptor, and the environmental property of the toner by the addition of the external additives.

The toner according to the invention can be used as it is as one-component developer or also as a two-component developer mixed with a carrier. As the carrier, known magnetic particles can be used. Specific examples of the magnetic particles include metals such as iron, ferrite, and magnetite, and alloys of such metals with other metal, for example, aluminum or lead. Among them, ferrite is preferred. A resin layer may be disposed to the surface of the carrier. The synthetic resin used for the resin layer includes, for example, olefinic resin, styrenic resin, styrenic/acrylic resin, silicone type resin, ester type resin, and fluorine-containing polymeric resin.

The shape of the carrier is preferably a spherical or flat shape. Further, while the particle size of the carrier is not particularly restricted, it is, preferably, from 10 to 100 μm and, more preferably, from 20 to 50 μm in view of the improvement for high image quality. Further, the resistivity of the carrier is preferably $10^8$ Ω·cm or higher, and, more preferably, $10^{12}$ Ω·cm or higher. The resistivity of the carrier is a value obtained by packing the carrier into a container having a cross sectional area of 0.50 $cm^2$, applying tapping, then, applying a load of 1 $kg/cm^2$ on the particles packed in the container, and reading a current value upon applying a voltage that causes an electric field of 1,000 V/cm between the load and the bottom electrode. In a case where the resistivity is low, when a bias voltage is applied to a developing sleeve, charges are injected into the carrier and carrier particles tend to be attached on the photoreceptor. Further, break down of the bias voltage tends to occur.

The magnetization strength (maximum magnetization) of the carrier is, preferably, from 10 to 60 emu/g and, more preferably, 15 to 40 emu/g. The magnetization strength depends on the magnetic flux density of a developing roller and, in a case where the magnetization is less than 10 emu/g under usual conditions for the magnetic flux density of the developing roller, a magnetic attracting force does not exert to possibly cause scattering of the carrier. In a case where the magnetization strength exceeds 60 emu/g, it becomes difficult to keep a non-contact state with an image support in a non-contact development where the magnetic brush of the carrier is excessively high. Further, in the contact development, sweeping trace tends to appear in the toner images.

The ratio of the toner and carrier used in the two-component developer is not particularly restricted and can be selected properly depending on the kind of the toner and the carrier. However, referring to a resin-coated carrier (density 5 to 8 $g/cm^2$) as an example, the toner may be used such that it is contained by from 2 to 30% by weight and, preferably, from 2 to 20% by weight based on the entire amount in the developer. Further, in the two-component developer, coverage of the carrier with the toner is preferably from 40 to 80%.

By using the two-component developer containing the toner obtained by the manufacturing method according to the invention, it is possible to form high quality images at high definition and high resolution, with no filming to the photoreceptor and occurrence of the offset phenomenon in a high temperature region caused by the bleed-out of the wax.

Figure 7:
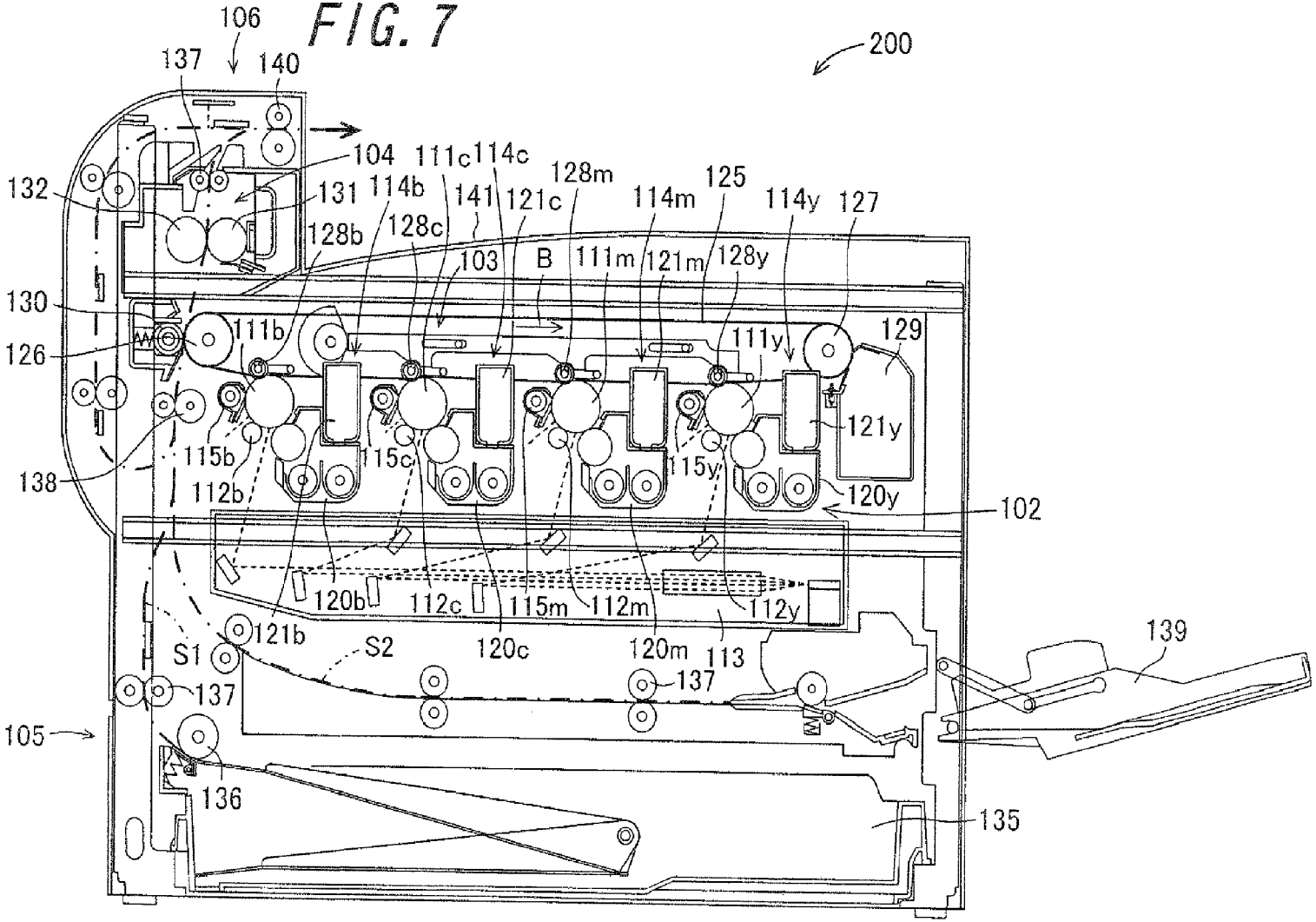
FIG. 7 is a cross sectional view schematically showing the constitution of an image forming apparatus according to an embodiment of the invention.

FIG. 7 is a cross sectional view schematically showing the constitution of an image forming apparatus 200 according to an embodiment of the invention. The image forming apparatus is a multifunction printer having a copying function, a printer function, and a facsimile function together, and forms full color or monochromatic images on a recording medium in accordance with image information to be transmitted. That is, the image forming apparatus has three types of printing modes, that is, a copier mode (reproduction mode), a printer mode, and a facsimile mode in which the printing mode is selected by a control section (not shown) in accordance with an operation input from an operation section (not shown), reception of a printing job from a personal computer, a portable terminal equipment, information recording memory medium, or an external apparatus using a memory device. The image forming apparatus includes a toner image forming section 102, a transfer section 103, a fixing section 104, a recording medium feeding section 105, and an exhausting section 106. Each of the members constituting the toner image forming section 102 and several members contained in the intermediate transfer section 103 are disposed each by four for corresponding image information of respective colors of black (b), cyan (c), magenta (m), and yellow (y) contained in the color image information. In this case, each of the members disposed by four in accordance with each color is distinguished by attaching an alphabetical reference that represents each color to the end of the reference numeral and represented only by the reference numeral when referred to generally.

The toner image forming section 102 includes a photoreceptor drum 111, a charging section 112, an exposure unit 113, a developing device 114, and a cleaning unit 115. The charging section 112, the developing device 114, and the cleaning unit 115 are arranged in this order around the photoreceptor drum 111. The charging section 112 is disposed below the developing device 114 and the cleaning unit 115 in the vertical direction.

The photoreceptor drum 111 is supported to be rotatable about an axis thereof by a drive mechanism (not shown), and includes a conductive substrate and a photosensitive layer formed on a surface of the conductive substrate, which are not shown. The conductive substrate may take various shapes including, for example, a cylindrical shape, a columnar shape, and a thin-film sheet-like shape. Among them, a cylindrical shape is preferred. The conductive substrate is formed of a conductive material. As the conductive material, those used customarily in this field can be used and examples thereof include metals such as aluminum, copper, brass, zinc, nickel, stainless steel, chromium, molybdenum, vanadium, indium, titanium, gold, and platinum, alloys of two or more of such metals, conductive films obtained by forming a conductive layer comprising one or more members such as aluminum, aluminum alloy, tin oxide, gold, and indium oxide on a film-like substrate such as a synthetic resin film, metal film, or paper, and a resin composition containing conductive particles and/or conductive polymer. As the film-like substrate used for the conductive film, a synthetic film is preferred, and a polyester film is particularly preferred. Further, as a method of forming the conductive layer in the conductive film, vapor deposition, coating, etc. are preferred.

The photosensitive layer is formed, for example, by laminating a charge generating layer containing a charge generating substance, and a charge transporting layer containing a charge transporting substance. In this case, an underlayer is disposed preferably between the conductive substrate and the charge generating layer or the charge transporting layer. Provision of the underlayer can provide advantages such as covering the injuries and unevenness present on the surface of the conductive substrate to make the surface of the photosensitive layer smooth, preventing degradation of the chargeability of the photosensitive layer during repetitive use, improving the charging property of the photosensitive layer under a low temperature and/or low humidity circumstance, etc. Further, the photoreceptor may be a layered photoreceptor of a three-layered structure of high durability by providing a surface protection layer for photoreceptor as the uppermost layer.

The charge generating layer comprises a charge generating substance that generates charges under irradiation of a light as a main ingredient and contains optionally known binder resin, plasticizer, sensitizer, etc. As the charge generating substance, those customarily used in this field can be used, and examples thereof include perylene pigments such as perylene imide and perylenic acid anhydride, polycyclic quinone dyes such as quinacrydone and anthraquinone, phthalocyanine dyes such as metal and non-metal phthalocyanines and halogenated non-metal phthalocyanine, and azo pigments having squalirium colorant, azulenium colorant, thiapyrylium colorant, carbazole skeleton, styryl stylbene skeleton, triphenyl amine skeleton, dibenzothiophene skeleton, oxadiazole skeleton, fluorenone skeleton, bisstylbene skeleton, distyryloxadiazole skeleton, or distyryl carbazole skeleton. Among them, non-metal phthalocyanine pigments, oxotitanyl phthalocyanine pigments, bisazo pigments containing fluorene ring, and/or fluorenone ring, bisazo pigments comprising aromatic amine, tris azo pigments, etc. have high charge generating property and are suitable for obtaining a photosensitive layer at high sensitivity. The charge generating substances may be used each alone or two or more kinds of them may be used in combination. While the content of the charge generating substance is not particularly restricted, it is, preferably, from 5 to 500 parts by weight and, more preferably, from 10 to 200 parts by weight based on 100 parts by weight of the binder resin in the charge generating layer. Also as the binder resin for the charge generating layer, those customarily used in this field can be used and examples thereof include melamine resin, epoxy resin, silicone resin, polyurethane, acrylresin, vinyl chloride-vinyl acetate copolymer resin, polycarbonate, phenoxy resin, polyvinyl butylal, polyarylate, polyamide, and polyester. The binder resins may be used each alone or, optionally, two or more kinds of them may be used in combination.

The charge generating layer can be formed by preparing a coating solution for the charge generating layer by dissolving or dispersing a charge generating substance and a hinder resin and, optionally, a plasticizer, a sensitizer, etc. each in an appropriate amount into an appropriate organic solvent capable of dissolving or dispersing the ingredients described above, and coating the surface of a conductive substrate with the coating solution for the charge generating layer, followed by drying. While the thickness of the thus obtained charge generating layer is not particularly restricted, it is preferably from 0.05 to 5 μm and, more preferably, from 0.1 to 2.5 μm.

The charge transporting layer laminated on the charge generating layer comprises a charge transporting substance having a function of accepting and transporting charges generated from the charge generating substance and a binder resin for the charge transporting layer as essential ingredients and contains, optionally, for example, known antioxidant, plasticizer, sensitizer, and lubricant. As the charge transporting substance, those used customarily in this field can be used, and examples thereof include electron donating substances such as poly-N-vinyl carbazole and derivatives thereof, poly-γ-carbazoyl ethyl glutamate and derivatives thereof, pyrene-formaldehyde condensate and derivatives thereof, polyvinyl pyrene, polyvinyl phenanthrene, oxazole derivatives, oxadiazole derivatives, imidazole derivatives, 9-(p-diethylamino styryl)anthracene, 1,1-bis(4-dibenzylamino phenyl)propane, styryl anthracene, styryl pyrazolin, pyrazolin derivatives, phenyl hydrazones, hydrazone derivatives, triphenylamine compounds, tetraphenyl diamine compounds, triphenyl methane compounds, stylbene compounds, and azine compounds having 3-methyl-2-benzothiazolin ring; and electron accepting substances such as fluorenone derivatives, dibenzothiophene derivatives, indenothiphene derivatives, phenanthrene quinone derivatives, indenopyridine derivatives, thioxantone derivatives, benzo[c]cinnoline derivatives, phenadine oxide derivatives, tetracyano ethylene, tetracyano quinodimethane, bromanil, chloranil, and benzoquionone.

The charge transporting substances may be used each alone, or two or more kinds of them may be used in combination. While the content of the charge transporting substance is not particularly restricted, it is preferably from 10 to 300 parts by weight and, more preferably, from 30 to 150 parts by weight based on 100 parts by weight of the binder resin in the charge transporting substance. As the binder resin for the charge transporting layer, those customarily used in this field and capable of uniformly dispersing the charge transporting substance can be used, and examples thereof include polycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin, and copolymer resins thereof. Among them, polycarbonate containing bisphenol Z as the monomer ingredient (hereinafter referred to as "bisphenol Z type polycarbonate"), a mixture of the bisphenol Z type carbonate and other polycarbonates, etc. are preferred an view of the wear resistance, electric property, etc. of the obtained charge transporting layer. The binder resins may be used each alone, or two or more kinds of them may be used in combination.

In the charge transporting layer, an antioxidant is contained preferably together with the charge transporting substance and the binder resin for the charge transporting layer. Also as the antioxidant, those customarily used in this field can be used, and examples thereof include vitamin E, hydroquinone, hindered amine, hindered phenol, paraphenylene diamine, arylalkane, and derivatives thereof, organic sulfur compounds, and organic phosphorus compounds. The antioxidants may be used each alone, or two or more kinds of them may be used in combination. While the content of the antioxidant is not particularly restricted, it is from 0.01 to 10% by weight and, preferably, from 0.05 to 5% by weight based on the total amount of the ingredients constituting the charge transporting layer. The charge transporting layer can be formed by preparing a coating solution for the charge transporting layer by dissolving or dispersing the charge transporting substance and the binder resin and, optionally, antioxidant, plasticizer, sensitizer, etc. each in an appropriate amount into an appropriate organic solvent capable of dissolving or dispersing the ingredients described above, and coating the surface of the charge generating layer with the coating solution for the charge transporting layer, followed by drying. While the thickness of the thus obtained charge generating layer is not particularly restricted, it is, preferably, from 10 to 50 μm and, more preferably, from 15 to 40 μm. Further, a photosensitive layer in which the charge generating substance and the charge transporting substance are present in one layer can also be formed. In this case, the type and the content of the charge generating substance and the charge transporting substance, the type of the binder resin and other additives may be identical with those in the case of forming the charge generating layer and the charge transporting layer separately.

In this embodiment, a photoreceptor drum formed with the organic photosensitive layer using the charge generating substance and the charge transporting substance is used but, instead, a photoreceptor drum formed with an inorganic photosensitive layer using, for example, silicon can be used.

The charging section 112 is arranged so as to be opposed to the photoreceptor drum 111 and spaced apart from the surface of the photoreceptor drum 111 along the longitudinal direction of the photoreceptor drum 111, and charges the surface of the photoreceptor drum 111 to a predetermined polarity and potential. As the charging section 112, a charging brush type charging device, a charger type charging device, a pin array type charging device, an ion generator, etc. can be used. In this embodiment, the charging section 112 is disposed being spaced apart from the surface of the photoreceptor drum 111, this is not restrictive. For example, a charging roller may be used as the charging section 112 and a charging roller may be disposed such that the charging roller and the photoreceptor drum are in pressure-contact with each other, or a contact charge type charging device such as a charging brush or magnetic brush may also be used.

The exposure unit 113 is arranged such that a light beam corresponding to each color information emitted from the exposure unit 113 passes between the charging section 112 and the developing device 114 and the surface of the photoreceptor drum 111 is irradiated with the light beam. The exposure unit 113 converts the image information into a light beam corresponding to each color information of b, c, m, and y in the unit and exposes the surface of the photoreceptor drum 111 charged to a uniform potential by the charging device 112 to the light beam corresponding to each color information to form electrostatic latent images on the surface thereof. As the exposure unit 113, a laser scanning unit, for example, having a laser irradiation section and a plurality of reflection mirrors can be used. In addition, a unit of properly combining an LED array, a liquid crystal shutter and a light source may also be used.

Figure 8:
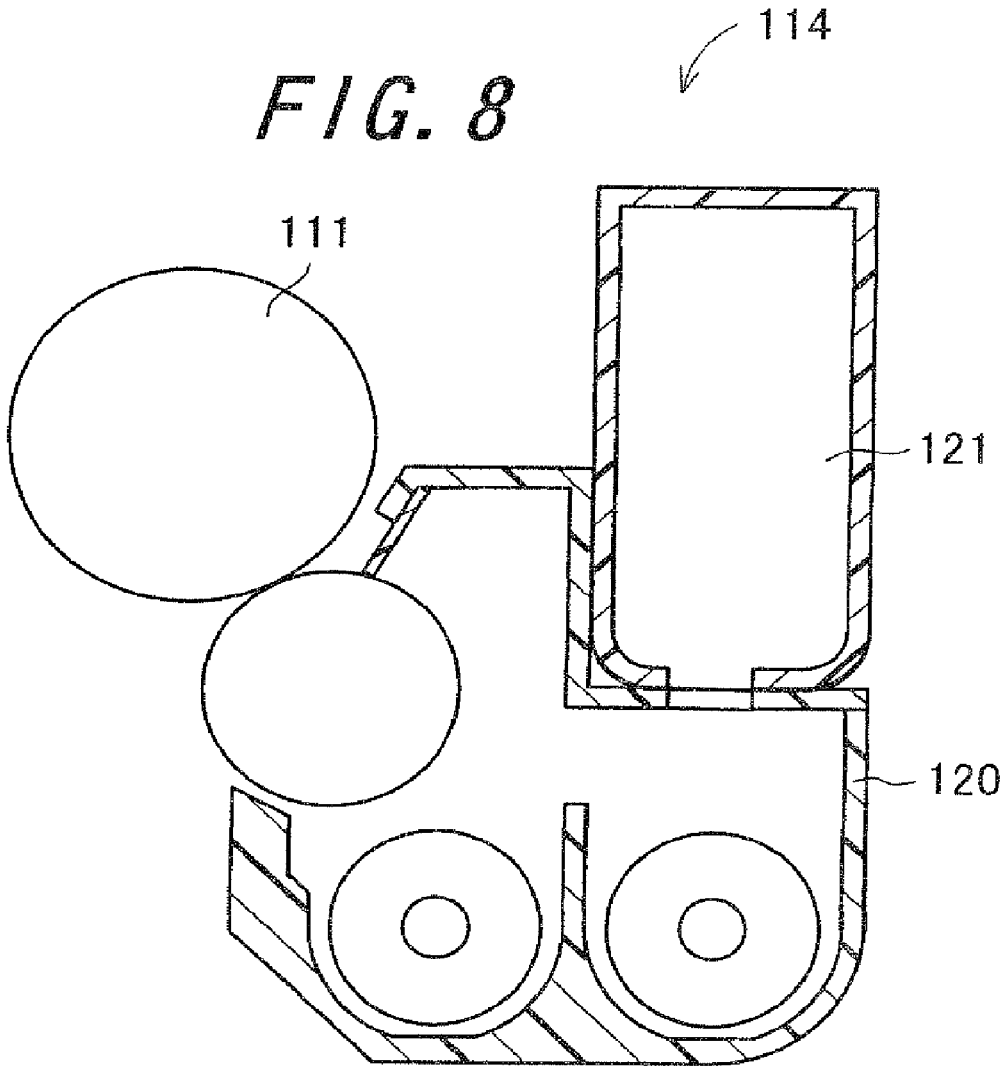
FIG. 8 is a cross sectional view schematically showing the constitution of a developing device according to an embodiment of the invention.

FIG. 8 is a cross sectional view schematically showing the constitution of the developing device 114 according to an embodiment of the invention. The developing device 114 includes a developing tank 120 and a toner hopper 121. The developing tank 120 is a container-shaped member that is arranged so as to be opposed to the surface of the photoreceptor drum 111, supplies a toner to electrostatic latent images formed on the surface of the photoreceptor drum 111 and forms toner images as visible images. The developing tank 120 contains a toner in the inner space thereof and contains and rotationally supports roller members such as a developing roller, a feed roller, a stirring roller, and a screw member. An opening is formed to the developing tank 120 on the lateral side opposed to the photoreceptor drum 111, and the developing roller is disposed such that it can be driven rotationally at a position opposed to the photoreceptor drum 111 by way of the opening. The developing roller is a roller-shape member for supplying a toner to the electrostatic latent images on the surface of the photoreceptor 111 at a pressure-contact portion or a nearest contact portion with the photoreceptor drum 111. Upon feeding the toner, a potential at a polarity opposite to the charging potential of the toner is applied as a developing bias voltage to the surface of the developing roller. This smoothly feeds the toner on the surface of the developing roller to the electrostatic latent images. Further, by changing the developing bias voltage value, the amount of the toner supplied to the electrostatic latent images (toner attachment amount) can be controlled. The feed roller is a roller-shape member disposed so as to be opposed to the developing roller such that it can be rotated, and supplies the toner to the periphery of the developing roller. The stirring roller is a roller shape member disposed so as to be opposed to the feed roller such that it can be driven rotationally, and supplies a toner supplied freshly from the toner hopper 121 into the developing tank 120 to the periphery of the feed roller. The toner hopper 121 is disposed such that a toner replenishment port (not shown) disposed at its lower portion in the vertical direction and a toner receiving port (not shown) disposed at an upper portion of the developing tank 120 in the vertical direction are in communication with each other, and replenishes the toner in accordance with the state of consumption of the toner in the developing tank 120. Further, it may also be constituted such that the toner is replenished directly from a toner cartridge for each color without using the toner hopper 121.

Toner images of high quality at high definition and high resolution can be formed on the photoreceptor by development using the two component developer according to the invention.

After transfer of the toner images to the recording medium, the cleaning unit 115 removes the toner remaining on the surface of the photoreceptor drum 111 and cleans the surface of the photoreceptor drum 111. As the cleaning unit 115, a plate member such as a cleaning blade is used for instance. In the image forming apparatus according to the invention, an organic photoreceptor drum is mainly used as the photoreceptor drum 111 and. Since the surface of the organic photoreceptor drum mainly comprises a resin ingredient, deterioration on the surface tends to proceed by the chemical action of ozone generated by corona discharge of the charging device. By the way, the deteriorated surface portion is abraded under the frictional effect by the cleaning unit 115 and removed reliably although gradually. Accordingly, the problem of deterioration on the surface due to ozone or the like is substantially eliminated, and the charging potential by the charging operation can be maintained stably for a long time. While the cleaning unit 115 is disposed in this embodiment, it is not restrictive but the cleaning unit 115 may be not disposed.

According to the toner image forming section 102, a signal light in accordance with the image information is emitted from the exposure unit 113 to the surface of the photoreceptor drum 111 in a uniformly charged state by the charging section 112 to form the electrostatic latent images, to which the toner is supplied from the developing device 114 to form toner images and, after transferred the toner images to an intermediate transfer belt 125, the toner remaining on the photoreceptor drum 111 is removed by the cleaning unit 115. The series of toner image forming operations are conducted repetitively.

The transfer section 103 is disposed above the photoreceptor drum 111 and includes an intermediate transfer belt 125, a driving roller 126, a driven roller 127, and an intermediate rollers 128 (b, c, m, y), a transfer belt cleaning unit 129, and a transfer roller 130. The intermediate transfer belt 125 is an endless belt member forming a loop-like moving path which is stretched between the driving roller 126 and the driven roller 127, and is driven rotationally in the direction of an arrow B. When the intermediate transfer belt 125 passes by the photoreceptor drum 111 while being in contact with the photoreceptor drum 111, a transfer bias voltage at a polarity opposite to the charging polarity of the toner on, the surface of the photoreceptor drum 111 is applied from the intermediate transfer roller 128 disposed so as to be opposed to the photoreceptor drum 111 by way of the intermediate transfer belt 125, and the toner images formed on the surface of the photoreceptor drum 111 are transferred to the intermediate transfer belt 125. In a case of full color images, toner images of each color formed on each of the photoreceptor drum 111 are successively transferred and overlaid on the intermediate transfer belt 125, full color toner images are formed. The driving roller 126 is disposed so as to drive rotationally about an axis thereof by a drive mechanism (not shown) to rotate the intermediate transfer belt 125 by the rotational driving in the direction of an arrow B. The driven roller 127 is disposed so as to be driven rotationally following the rotational driving of the driving roller 126 and provides a predetermined tension to the intermediate transfer belt 125 such that the intermediate transfer belt 125 does not slack. The intermediate transfer roller 128 is in pressure-contact with the photoreceptor drum 111 by way of the intermediate transfer belt 125 and disposed such that it can be rotationally driven about an axis thereof by a drive mechanism (not shown). The intermediate transfer roller 128 is connected to a power source (not shown) for applying the transfer bias voltage as described above, and has a function of transferring toner images on the surface of the photoreceptor drum 111 to the intermediate transfer belt 125. The transfer belt cleaning unit 129 is disposed so as to be opposed by way of the intermediate transfer belt 125 to the driven roller 127 and is in contact with the outer circumferential surface of the intermediate transfer belt 125. Since the toner attached to the intermediate transfer belt 125 due to contact with the photoreceptor drum 111 causes contamination of the rear face of the recording medium, the transfer belt cleaning unit 129 removes and recovers the toner on the surface of the intermediate transfer belt 125. The transfer roller 130 is disposed so as to be in pressure-contact with the driving roller 126 by way of the intermediate transfer belt 125, and can be driven rotationally about an axis thereof by a drive mechanism (not shown). Toner images that are conveyed with being borne on the intermediate transfer belt 125 are transferred to a recording medium supplied from a recording medium feeding section 105 to be described later at a pressure-contact portion (transfer nip portion) between the transfer roller 130 and the driving roller 126. The recording medium bearing the toner images is supplied to the fixing section 104. By the transfer section 103, toner images transferred from the photoreceptor drum 111 to the intermediate transfer belt 125 at the pressure-contact portion between the photoreceptor drum 111 and the intermediate transfer roller 128 are conveyed by the rotational driving of the intermediate transfer belt 125 in the direction of an arrow B to the transfer nip portion where they are transferred to the recording medium.

The fixing section 104 is disposed on a side of downstream in the conveying direction of the recording medium from the transfer section 103, and includes a fixing roller 131 and a pressure roller 132. The fixing roller 131 is disposed such that it can be rotated by a drive mechanism (not shown) and heats to fuse the toner constituting unfixed toner images borne on the recoding medium and fixes the same to the recording medium. A heating section (not shown) is disposed to the inside of the fixing roller 131. The heating section heats the fixing roller 131 such that the surface of the fixing roller 131 reaches a predetermined temperature (heating temperature). As the heating section, for example, a heater, halogen lamp, or the like can be used. The heating section is controlled by a fixing condition control section to be described later. Control for heating temperature by the fixing condition control section is to be described later specifically. A temperature detection sensor is disposed near the surface of the fixing roller 131 to detect the surface temperature of the fixing roller 131. The detection result by the temperature detection sensor is written into a memory portion of a control unit described later. The pressure roller 132 is disposed so as to be in pressure-contact with the fixing roller 131, and supported so as to be driven rotationally following the rotational driving of the fixing roller 131. The pressure roller 132 assists fixing of the toner images to the recording medium by pressing the toner and the recording medium at the time of fusing the toner by the fixing roller 131 and fixing it to the recording medium. The pressure-contact portion between the fixing roller 131 and the pressure roller 132 is a fixing nip portion. By the fixing section 104, when the recording medium transferred with the toner images in the transfer section 103 is put between the fixing roller 131 and the pressure roller 132 and passes through the fixing nip portion, the toner images are pressed under heating to the recording medium and they are fixed to the recording medium to form images.

The recording medium feeding section 105 includes an automatic paper feed tray 135, a pickup roller 136, conveying rollers 137, registration rollers 138, a manual paper feed tray 139. The automatic paper feed tray 135 is a container-like member disposed below the image forming apparatus in the vertical direction and stores the recording mediums. Examples of the recording mediums include plain paper, color copy paper, sheets for overhead projector use, and postcards. The pickup roller 136 takes out recording mediums stored in the automatic paper feed tray 135 one by one and feeds each recording medium to a paper conveyance path S1.

The conveying rollers 137 are a pair of roller members disposed so as to be in pressure-contact with each other and convey the recording medium to the registration rollers 138. The registration rollers 138 are a pair of roller members disposed so as to be in pressure-contact with each other and feed the recording medium fed from the conveying rollers 137 to the transfer nip portion in synchronization with the conveying of toner images borne on the intermediate transfer belt 125 to the transfer nip portion. The manual paper feed tray 139 is a device storing recording mediums which are different from the recording mediums stored in the automatic paper feed tray 135 and may have any size and which are to be taken into the image forming apparatus. The recording medium taken in from the manual paper feed tray 139 is made to pass through a paper conveyance path S2 by means of the conveying rollers 137 and fed to the registration rollers 138. The recording medium feeding section 105 feeds the recording mediums fed one by one from the automatic paper feed tray 135 or the manual paper feed tray 139 to the transfer nip portion in synchronization with the conveying of toner images borne on the intermediate transfer belt 125 to the transfer nip portion.

The discharge section 106 includes the conveying roller 137, discharging rollers 140 and a catch tray 141. The conveying rollers 137 are disposed on a side of downstream in the paper conveying direction from the fixing nip portion, and convey the recording medium to which the images are fixed by the fixing section 104, to the discharging rollers 140. The discharging rollers 140 discharge the recording medium to which the images are fixed, to the catch tray 141 disposed at the upper surface of the image forming apparatus in the vertical direction. The catch tray 141 stores recording mediums to which the images are fixed.

The image forming apparatus 200 includes a control unit (not shown). The control unit is disposed, for example, in an upper portion in the inner space of the image forming apparatus and includes a memory portion, a computing portion, and a control portion. The memory portion of the control unit is inputted, for example, with various setting values via an operation panel (not shown) disposed to the upper surface of the image forming apparatus, detection result from sensors (not shown), etc. disposed at each portion in the image forming apparatus, and image information from external apparatuses. Further, programs for executing operations of various functional elements are written in the memory portion. The various functional elements are, for example, a recording medium judging section, an attachment amount control section, the fixing condition control section, etc. As the memory portion, those customarily used in this field can be used and examples thereof include read only memory (ROM), random access memory (RAM), and hard disk drive (HDD). As the external apparatuses, electric and electronic apparatuses capable of forming or acquiring image information and capable of being electrically connected with the image forming apparatus can be used, and examples thereof include a computer, a digital camera, a television set, a video recorder, a DVD recorder, HDDVD, a blue ray disk recorder, a facsimile unit, and a portable terminal apparatus. The computing portion takes out various data written into the memory portion (image forming instruction, detection result, image formation, etc.) and programs for various functional elements to conduct various judgments. The control portion delivers control signals to the relevant apparatus in accordance with the result of judgment of the calculation section to conduct operation control. The control portion and the computing portion include a processing circuit provided by a microcomputer, a microprocessor, etc. provided with a central processing unit (CPU). The control unit includes a main power source together with the processing circuit described above, and the power source supplies power not only to the control unit but also to each of the devices in the inside of the image forming apparatus.

By forming images using the image forming apparatus having the developing device according to the invention, high quality image at high definition and high resolution excellent in the reproducibility of the original images can be formed.

EXAMPLE

The invention is to be described specifically with reference to examples and comparative examples. In the followings, "parts" and "%" mean "parts by weight" and "% by weight" respectively unless otherwise specified.

Example 1

[Preliminary Pulverizing Step]

88.5 parts of a polyester (weight average molecular weight: 80,000, Mw/Mn=24), 2 parts of a charge control agent (N4P, trade name, manufactured by Clariant Japan K.K.), 7.5 parts of carnauba wax, and 10 parts of a colorant (FC 1469) were mixed in a mixer (HENSCHEL MIXER, trade name, manufactured by Mitsui Mining Co., Ltd.), and the obtained starting toner mixture was melt-kneaded in a twin screw extruder (PCM-30, trade name, manufactured by Ikegai, Ltd.) at a cylinder temperature of 145° C. and a number of barrel rotation of 300 rpm to prepare a melt-kneaded product of the toner raw material. 10 parts of the melt-kneaded product and 100 parts of ion exchanged water were pulverized by a colloid mill (PUC COLLOID MILL TYPE 60, trade name, manufactured by Nippon Ball Valve Co., Ltd., clearance d1: 40 μm), to prepare a coarse powder slurry. Pulverization was conducted repetitively till the volume average particle size of the coarse toner powder contained in the coarse powder slurry was decreased to less than 100 μm to prepare a coarse powder slurry containing a coarse toner powder with a volume average particle size of 65 μm, a coefficient of variation (CV value) of 37, a minimum particle size of 7.7 μm, and a maximum particle size of 300.5 μm.

The minimum particle size and the maximum particle size were determined as described below. A portion of the coarse powder slurry was sampled, removed with the water content, washed with pure water, and dried to prepare a sample. The sample was observed by a scanning type electron microscope at a factor of 1,000× for 100 view fields and particle size for the relatively coarse powder particles and relatively small coarse powder particles were measured to determine the minimum particle size and the maximum particle size.

[Coarse Powder Slurry Stabilizing Step]

6 parts of a polymeric dispersant (JONCRYL 70, trade name, manufactured by Johnson Polymer LLC) was added and mixed to 94 parts of a coarse powder slurry.

[Finely Pulverizing Step]

A coarse powder slurry obtained in the coarse powder slurry stabilizing step was pressurized and heated to 210 MPa and 70° C. in a pressure resistant sealed container, and supplied from a pressure resistant pipeline attached to the pressure resistant sealed container to a pressure resistant nozzle attached to the outlet of the pressure resistant pipeline to conduct fine pulverization of the coarse toner powder and prepare a fine powder slurry containing a fine toner powder with a volume average particle size of 0.97 and a coefficient of variation of 31. The pressure resistant nozzle is a multi-nozzle of 0.5 cm length made of diamond in which two liquid flow holes of 0.085 mm hole diameter were formed substantially in parallel in the longitudinal direction of the nozzle spaced by a distance of 1.0 mm.

The number of slurry passing through the pressure resistant nozzle was 4 times. The temperature of the coarse powder slurry at the inlet of the pressure resistant nozzle was 70° C., the pressure applied to the coarse powder slurry was 210 MPa, the temperature of the fine powder slurry at the outlet of the nozzle was 120° C., and the pressure applied to the aqueous slurry was 42 MPa.

[Cooling Step]

The fine powder slurry discharged from the pressure resistant nozzle was introduced into a corrugated tube type cooler connected to the outlet of the pressure resistant nozzle and cooled. The temperature of the fine powder slurry at the outlet of the corrugated tube type cooler was 30° C. and the pressure applied to the fine powder slurry was 35 MPa.

[Aggregating and Pulverizing Step]

A fine powder slurry discharged from the outlet of the corrugated tube type cooler was introduced into a coiled pipeline connected to the outlet of the cooler and aggregation of the fine toner powder and pulverization of the formed aggregated particles were conducted to prepare aggregated particles with a volume average particle size of 5.3 μm and a coefficient of variation of 19. The coiled pipeline had a coil inner diameter of 4.0 mm, a coil radius of curvature of the coil of 38 mm, and a number of coil turns of 54.

[Depressurizing Step]

The fine powder slurry discharged from the outlet of the coiled pipeline (aggregated particle-containing slurry) was introduced to a multistage depressurization apparatus connected to the outlet of the coiled pipeline to conduct depressurization. The multistage depressurization apparatus had five pipe members made of stainless steel of different inner diameters connected by a seal member (O ring). The inner diameters of the pipe members were 1 mm, 0.9 mm, 0.75 mm, 0.5 mm, and 0.2 mm from an inlet of the multistage depressurization apparatus in this order.

[Cleaning-Drying Step]

Aggregated particles (toner) were recovered by filtration from a slurry discharged from the multistage depressurization apparatus and cleaning with pure water, dried by a hot air to prepare a toner according to the invention.

Examples 2 to 3

Toner according to the invention (aggregated particles) was manufactured in the same manner as in Example 1 except for changing the number of the fine powder slurry passing through the pressure resistant nozzle to 10 times (Example 2) or twice (Example 3) in the finely pulverizing step. The coarse toner powder, the fine toner powder, the volume average particle size (μm), and the coefficient of variation of the toner are shown in Table 1.

Example 4

Toner according to the invention (aggregated particles) was manufactured in the same manner as in Example 1 except for changing the clearance d1 in the colloid mill (PUC COLLOID MILL TYPE 60) from 40 μm to 50 μm. The volume average particle size (μm) and the coefficient of variation of the coarse toner powder, the fine toner powder and the toner are shown in Table 1.

Example 5

Toner according to the invention (aggregated particles) was manufactured in the same manner as in Example 1 except for conducting the depressurizing step after the cooling step and conducting the following aggregating step after the depressurizing step. The volume average particle size (μm) and the coefficient of variation of the coarse toner powder, the fine toner powder and the toner are shown in Table 1.

[Aggregating Step]

100 parts of a fine powder slurry discharged from the multistage depressurization apparatus, and 5 parts of a 20%-aqueous solution of stearyl trimethyl ammonium chloride (QUARTAMIN 86W, trade name, manufactured by Kao Corporation) were charged in a granulation apparatus (NEW GENERATION MIXER NGM-1.5TL, trade name, manufactured by Beryu Co., Ltd.), stirred at 75° C. for 30 min at 2,000 rpm and then temperature was elevated to 85° C. and stirring was conducted for further 2 hr. In order to aggregate unaggregated fine toner powder, 300 g of water was added after temperature elevation and rapidly cooled to a room temperature to prepare a fine powder slurry (aggregated particle-containing slurry). The granulation apparatus used herein had the same structure as the granulation apparatus 100 shown in FIG. 5. In the granulation apparatus, the stirring section 23 were disposed at a position where the distance H between the liquid surface of the fine powder slurry in the stirring container 21 and the upper end of the stirring blade on the side facing the first cover plate 24 was 2.0 cm, and the distance d2 between the bottom of the stirring container 21 and the surface of the second cover plate 25 on the side opposite to the side facing the first cover plate 24 was 0.5 cm. The inner diameter D of the stirring container 21 was 10.5 cm, the stirring blade tip speed was 3.14 m/s, and the wave height was 10 mm.

Aggregated particles (toner) were recovered by filtration from the fine powder slurry (aggregated particle-containing slurry) obtained described above, cleaned by pure water and then dried by a hot air to manufacture the toner according to the invention. The volume average particle size (μm) and the coefficient of variation of the coarse toner powder, the fine toner powder, and the toner are shown in Table 1.

Comparative Examples 1 to 2

Toners for comparison (aggregated particles) were manufactured in the same manner as in Example 1 except for changing the number of times of the fine powder slurry passing through the pressure resistant nozzle to 15 times (Comparative Example 1) or once (Comparative Example 2) in the finely pulverizing step. The volume average particle size (μm) and the coefficient of variation of the coarse toner powder, the fine toner powder, and the toner are shown in Table 1.

Comparative Example 3

When the same procedures were conducted in the same manner as in Example 1 except for changing the clearance d1 in the colloid mill (PUC COLLOID MILL TYPE 60) from 40 μm to 60 μm, clogging occurred in the pressure resistant nozzle by the coarse toner powder in the finely pulverizing step and subsequent steps could not be conducted. The volume average particle size (μm) and the coefficient of variation of the coarse powder slurry are shown in Table 1.

Comparative Example 4

A melt-kneaded product of the toner raw material was prepared in the same manner as in Example 1. After cooling the melt-kneaded product to a room temperature, it was pulverized by a cutter mill (VM-16, trade name of product, manufactured by Orient Co., Ltd.), to prepare a coarse toner powder of 500 to 800 μm particle size. 10 parts of the coarse toner powder, 1.7 parts of a 30% aqueous solution of polymeric dispersant (JONCRYL 70) and 90 parts of ion exchanged water were mixed to prepare a coarse powder slurry. The coarse powder slurry was passed through a nozzle of 0.5 cm nozzle length having a flow hole of 0.3 mm inner diameter under the pressure of 168 MPa to conduct preliminary pulverization and conditioned such that the volume average particle size of the coarse toner powder in the slurry was less than 100 μm (92 μm).

For the obtained coarse powder slurry, the finely pulverizing step, cooling step, the aggregating and pulverizing step, the depressurizing step and cleaning-drying step were conducted in the same manner as in Example 1 to prepare a comparative toner. The volume average particle size (μm) and the coefficient of variation of the coarse toner powder, the fine toner powder, and the toner are shown in Table 1.

Comparative Example 5

When procedures were conducted in the same manner as in Example 1 except for changing the colloid mill from the PUC COLLOID MILL TYPE 60 to DISPAMILL D (trade name, manufactured by Hosokawa Micron Corporation) and the clearance d1 from 40 μm to 200 μm, clogging occurred in the pressure resistant nozzle by a coarse toner powder in the finely pulverizing step and the subsequent steps could not be conducted. The volume average particle size (μm) and the coefficient of variation of the coarse powder slurry are shown in Table 1.

TABLE 1

| | | Preliminary pulverizing step | | | | | Finely pulverizing step | | | Aggregating and pulverizing step | |
|---|---|---|---|---|---|---|---|---|---|---|---|
| | | | Coarse toner powder/μm | | | | Number of passing | Fine Toner powder/μm | | Toner/μm | |
| | | d1 μm | Particle size | CV | Min | Max | through pressure resistant nozzle | Particle size | CV | Particle size | CV |
| Examples | 1 | 40 | 65.0 | 37 | 7.7 | 300.5 | 4 | 0.97 | 31 | 5.3 | 19 |
| | 2 | 40 | 65.0 | 37 | 7.7 | 300.5 | 10 | 0.65 | 35 | 4.9 | 22 |
| | 3 | 40 | 65.0 | 37 | 7.7 | 300.5 | 2 | 2.78 | 37 | 6.2 | 25 |
| | 4 | 50 | 78.2 | 42 | 9.1 | 402.1 | 4 | 1.17 | 30 | 5.5 | 21 |
| | 5 | 40 | 65.0 | 37 | 7.7 | 300.5 | 4 | 0.97 | 31 | 5.1 | 17 |
| Comparative Examples | 1 | 40 | 65.0 | 37 | 7.7 | 300.5 | 15 | 0.57 | 37 | 4.7 | 22 |
| | 2 | 40 | 65.0 | 37 | 7.7 | 300.5 | 1 | 3.31 | 39 | 7.1 | 32 |
| | 3 | 60 | 102.3 | 52 | 13.2 | 552.0 | — | — | — | — | — |
| | 4 | — | 263.6 | 63 | 10.1 | 1025 | — | — | — | — | — |
| | 5 | 200 | 65.0 | 37 | 7.7 | 300.5 | — | — | — | — | — |

From Table 1, since the CV value (coefficient of variation) was about 20 according to the manufacturing method according to the invention, it is apparent that a toner appropriately decreased in size with the particle shape being aligned and uniform can be obtained. The toner of Comparative Example 1 is excessively decreased in size and the toner property such as the cleaning property is lowered. Further, it can be seen that the toner of Combative Example 2 is not decreased in size with the particle size (volume average particle size) being 7.1 μm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising:

a preliminary pulverizing step of pulverizing a melt-kneaded product of a toner raw material in a liquid to obtain a coarse powder slurry containing a coarse toner powder the melt-kneaded product of the toner raw material being pulverized in the absence of a dispersant;

a finely pulverizing step of passing the coarse powder slurry obtained in the preliminary pulverizing step under heating and pressure through a pressure resistant nozzle, thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step; and a depressurizing step of depressurizing the fine powder slurry cooled in the cooling step.

2. The method of manufacturing a toner of claim 1, wherein the coarse powder slurry not containing particles of coarse toner powder with a particle size of more than 500 μm is obtained in the preliminary pulverizing step.

3. The method of manufacturing a toner of claim 1, wherein the liquid is water.

4. The method of manufacturing a toner of claim 1, wherein an aggregating and pulverizing step of generating a swirl in the fine powder slurry obtained in the finely pulverizing step under heating and pressure to aggregate the fine toner powder and pulverizing the obtained aggregates is interposed between the finely pulverizing step and the cooling step.

5. The method of manufacturing a toner of claim 1, wherein a volume average particle size of the fine toner powder is in a range of from 0.6 to 3 μm.

6. A method of manufacturing a toner comprising:

a preliminary pulverizing step of pulverizing a melt-kneaded product of a toner raw material in a liquid to obtain a coarse powder slurry containing a coarse toner powder the melt-kneaded product of the toner being pulverized such that a coefficient of variation in a volume particle size distribution of the coarse toner powder is from 25 to 45;

a finely pulverizing step of passing the coarse powder slurry obtained in the preliminary pulverizing step under heating and pressure through a pressure resistant nozzle, thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step; and a depressurizing step of depressurizing the fine powder slurry cooled in the cooling step.

7. A method of manufacturing a toner comprising:

a preliminary pulverizing step of pulverizing a melt-kneaded product of a toner raw material in a liquid to obtain a coarse powder slurry containing a coarse toner powder, a colloid mill including a cylindrical stator member disposed rotationally and a columnar rotor member disposed rotationally in the inside of the cylindrical stator member being used, and the melt-kneaded product of the toner raw material being pulverized by passing a mixture of the melt-kneaded product of the toner raw material and a liquid through a gap between the cylindrical stator member and the columnar rotor member in the colloid mill;

a finely pulverizing step of passing the coarse powder slurry obtained in the preliminary pulverizing step under heating and pressure through a pressure resistant nozzle, thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step; and a depressurizing step of depressurizing the fine powder slurry cooled in the cooling step.

8. The method of manufacturing a toner of claim 7, wherein the gap between the cylindrical stator member and the columnar rotor member is 50 μm or less.

9. A method of manufacturing a toner comprising:

a preliminary pulverizing step of pulverizing a melt-kneaded product of a toner raw material in a liquid to obtain a coarse powder slurry containing a coarse toner powder;

a coarse powder slurry stabilizing step of adding a dispersant to the coarse powder slurry obtained in the preliminary pulverizing step;

a finely pulverizing step of passing the coarse powder slurry obtained in the preliminary pulverizing step under heating and pressure through a pressure resistant nozzle, thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step; and a depressurizing step of depressurizing the fine powder slurry cooled in the cooling step.

10. A method of manufacturing a toner comprising:

a preliminary pulverizing step of pulverizing a melt-kneaded product of a toner raw material in a liquid to obtain a coarse powder slurry containing a coarse toner powder;

a finely pulverizing step of passing the coarse powder slurry obtained in the preliminary pulverizing step under heating and pressure through a pressure resistant nozzle, thereby further pulverizing the coarse toner powder to obtain a fine powder slurry containing a fine toner powder with a smaller volume average particle size than that of the coarse toner powder and in a heated and pressurized state;

a cooling step of cooling the fine powder slurry obtained in the finely pulverizing step;

a depressurizing step of depressurizing the fine powder slurry cooled in the cooling step, and an aggregating step of aggregating the fine toner powder contained in the fine powder slurry after the depressurizing step, by using a granulation apparatus having a container for containing a fine powder slurry, a stirring member disposed in the container and stirring the fine powder slurry contained in the container, and two or more screen members formed with a plurality of fine powder slurry flow holes disposed so as to surround the stirring member and penetrating in the direction of the thickness.

* * * * *